US011383111B2

(12) United States Patent
Daniels

(10) Patent No.: US 11,383,111 B2
(45) Date of Patent: Jul. 12, 2022

(54) EMBER-RESISTANT AND FLAME-RESISTANT ROOF VENTILATION SYSTEM

(71) Applicant: Gregory S. Daniels, Santa Rosa, CA (US)

(72) Inventor: Gregory S. Daniels, Santa Rosa, CA (US)

( * ) Notice: Subject to any disclaimer, the term of this patent is extended or adjusted under 35 U.S.C. 154(b) by 33 days.

(21) Appl. No.: 16/158,004

(22) Filed: Oct. 11, 2018

(65) Prior Publication Data

US 2019/0262641 A1 Aug. 29, 2019

Related U.S. Application Data

(63) Continuation of application No. 14/688,847, filed on Apr. 16, 2015, now Pat. No. 10,105,559, which is a (Continued)

(51) Int. Cl.
*A62C 2/06* (2006.01)
*F24F 11/00* (2018.01)
(Continued)

(52) U.S. Cl.
CPC ..... *A62C 3/14* (2013.01); *E04D 13/17* (2013.01); *F24F 7/02* (2013.01); *F24F 11/0001* (2013.01);
(Continued)

(58) Field of Classification Search
CPC .. F24F 7/02; F24F 2011/0095; F24F 11/0001; F24F 11/33; F24F 13/082;
(Continued)

(56) References Cited

U.S. PATENT DOCUMENTS 2,343,764 A 3/1944 Fuller
2,638,835 A 5/1953 Strawsine
(Continued)

FOREIGN PATENT DOCUMENTS

DE 28 04 301 8/1979
DE 31 32 152 6/1982
(Continued)

OTHER PUBLICATIONS

2001 California Building Code, Jun. 21, 2006. Chaper 7A, pp. 1-90.3-1.90.5. (Year: 2001).*
(Continued)

*Primary Examiner* — Avinash A Savani
*Assistant Examiner* — Dana K Tighe
(74) *Attorney, Agent, or Firm* — Knobbe, Martens, Olson & Bear, LLP

(57) ABSTRACT

This application relates to ventilation systems, more particularly to roof ventilation systems that help to protect buildings against fires. The roof vent has an ember impedance structure that impedes the entry of flames and embers or other floating burning materials while still permitting sufficient air flow to adequately ventilate a building. Several configurations of vents employing baffle members and fire-resistant mesh material are described, which can substantially prevent the ingress of floating embers and flames.

18 Claims, 16 Drawing Sheets

Related U.S. Application Data continuation of application No. 12/465,236, filed on May 13, 2009, now Pat. No. 9,011,221.

(60) Provisional application No. 61/052,862, filed on May 13, 2008.

(51) Int. Cl.

| | |
|---|---|
| ***E04D 13/17*** | (2006.01) |
| ***F24F 13/08*** | (2006.01) |
| ***F24F 7/02*** | (2006.01) |
| *E04D 1/30* | (2006.01) |
| *F24F 11/33* | (2018.01) |

(52) U.S. Cl.

CPC ..... *F24F 13/082* (2013.01); *E04D 2001/309* (2013.01); *F24F 11/33* (2018.01); *F24F 2221/30* (2013.01)

(58) Field of Classification Search

CPC ..... F24F 2221/30; E04D 2001/309; E04D 13/174; E04D 13/176; E04D 13/17; A62C 3/14

USPC ..... 454/260, 365, 366, 367; 52/198, 199

See application file for complete search history.

(56) References Cited

U.S. PATENT DOCUMENTS

| | | | |
|---|---|---|---|
| 2,733,649 | A | 2/1956 | LeBarron |
| 3,027,090 | A | 3/1962 | Zerhan, Jr. |
| 3,311,047 | A | 3/1967 | Smith et al. |
| 3,368,473 | A | 2/1968 | Sohda et al. |
| 3,376,164 | A | 4/1968 | Baehwansky et al. |
| 3,598,686 | A | 8/1971 | Clark |
| 3,598,688 | A | 8/1971 | Bellamy |
| 3,685,596 | A | 8/1972 | Collins |
| 3,780,872 | A | 12/1973 | Pall |
| 3,951,336 | A | 4/1976 | Miller et al. |
| 4,040,867 | A | 8/1977 | Forestier et al. |
| 4,054,729 | A | 10/1977 | Isenberg |
| 4,083,097 | A | 4/1978 | Anagnostou et al. |
| 4,090,435 | A | 5/1978 | Vallee |
| 4,097,308 | A | 6/1978 | Klein et al. |
| 4,189,881 | A | 2/1980 | Hawley |
| 4,201,121 | A | 5/1980 | Brandenburg, Jr. |
| 4,224,081 | A | 9/1980 | Kawamura et al. |
| 4,228,729 | A | 10/1980 | Messick |
| 4,239,555 | A | 12/1980 | Scharlack et al. |
| 4,251,026 | A | 2/1981 | Siegel et al. |
| 4,314,548 | A | 2/1982 | Hanson |
| 4,382,435 | A | 5/1983 | Brill-Edwards |
| 4,383,129 | A | 5/1983 | Gupta et al. |
| 4,432,273 | A | 2/1984 | Devitt |
| 4,433,200 | A | 2/1984 | Jester et al. |
| 4,530,273 | A | 7/1985 | Smith |
| 4,574,160 | A | 3/1986 | Cull et al. |
| 4,602,739 | A | 7/1986 | Sutton, Jr. |
| D285,829 | S | 9/1986 | Lock |
| 4,625,469 | A | 12/1986 | Gentry et al. |
| 4,692,557 | A | 9/1987 | Samuelson et al. |
| 4,759,272 | A | 7/1988 | Zaniewski |
| 4,803,816 | A | 2/1989 | Klober |
| 4,843,794 | A | 7/1989 | Holtgreve |
| 4,850,166 | A | 7/1989 | Taylor |
| 4,965,971 | A | 10/1990 | Jean-Jacques et al. |
| 4,977,818 | A | 12/1990 | Taylor et al. |
| 4,986,469 | A | 1/1991 | Sutton, Jr. |
| 4,995,308 | A | 2/1991 | Waggoner et al. |
| 5,048,225 | A | 9/1991 | Brandli |
| 5,049,801 | A | 9/1991 | Potter |
| 5,060,444 | A | 10/1991 | Paquette |
| 5,078,047 | A | 1/1992 | Wimberly |
| 5,095,810 | A | 5/1992 | Robinson |
| 5,122,095 | A | 6/1992 | Wolfert |
| 5,131,200 | A | 7/1992 | McKinnon |
| 5,131,888 | A | 7/1992 | Adkins, II |
| 5,167,579 | A | 12/1992 | Rotter |
| 5,228,925 | A | 7/1993 | Nath et al. |
| 5,232,518 | A | 8/1993 | Nath et al. |
| 5,296,043 | A | 3/1994 | Kawakami et al. |
| 5,316,592 | A | 5/1994 | Dinwoodie |
| 5,333,783 | A | 8/1994 | Catan |
| 5,364,026 | A | 11/1994 | Kundert |
| 5,391,235 | A | 2/1995 | Inoue |
| 5,427,571 | A | 6/1995 | Sells et al. |
| 5,458,538 | A | 10/1995 | MacLeod et al. |
| 5,480,494 | A | 1/1996 | Inoue |
| 5,486,238 | A | 1/1996 | Nakagawa et al. |
| 5,505,788 | A | 4/1996 | Dinwoodie |
| 5,528,229 | A | 6/1996 | Mehta |
| 5,561,953 | A | 10/1996 | Rotter |
| 5,620,368 | A | 4/1997 | Bates et al. |
| 5,697,192 | A | 12/1997 | Inoue |
| 5,706,617 | A | 1/1998 | Hirai et al. |
| 5,722,887 | A | 3/1998 | Wolfson et al. |
| 5,728,000 | A | 3/1998 | Bateman |
| 5,740,636 | A | 4/1998 | Archard |
| 5,746,653 | A | 5/1998 | Palmer et al. |
| 5,746,839 | A | 5/1998 | Dinwoodie |
| 5,766,681 | A | 6/1998 | Stoddart et al. |
| 5,772,502 | A | 6/1998 | Smith |
| 5,814,118 | A | 9/1998 | Wickland et al. |
| 5,890,322 | A | 4/1999 | Fears |
| 5,971,848 | A | 10/1999 | Nair |
| 5,990,414 | A | 11/1999 | Posnansky |
| 6,008,450 | A | 12/1999 | Ohtsuka et al. |
| 6,050,039 | A | 4/2000 | O'Hagin |
| 6,051,774 | A | 4/2000 | Yoshida et al. |
| 6,061,978 | A | 5/2000 | Dinwoodie et al. |
| 6,077,159 | A | 6/2000 | Clayton |
| 6,105,317 | A | 8/2000 | Tomiuchi et al. |
| 6,129,628 | A | 10/2000 | O'Hagin et al. |
| 6,155,006 | A | 12/2000 | Mimura et al. |
| 6,220,956 | B1 | 4/2001 | Killian et al. |
| 6,227,963 | B1 | 5/2001 | Headrick |
| 6,241,602 | B1 | 6/2001 | Allen |
| 6,242,685 | B1 | 6/2001 | Mizukami |
| 6,243,995 | B1 | 6/2001 | Reeves et al. |
| 6,277,024 | B1 | 8/2001 | Coulton |
| 6,286,273 | B1 | 9/2001 | Villela et al. |
| 6,294,724 | B1 | 9/2001 | Sasaoka et al. |
| 6,306,030 | B1 | 10/2001 | Wilson |
| 6,308,473 | B1 | 10/2001 | Auck |
| 6,336,304 | B1 | 1/2002 | Mimura et al. |
| 6,361,434 | B1 | 3/2002 | Brandon |
| 6,365,824 | B1 | 4/2002 | Nakazima et al. |
| 6,371,847 | B2 | 4/2002 | Headrick |
| 6,390,914 | B1 | 5/2002 | O'Hagin et al. |
| 6,415,559 | B1 | 7/2002 | Reeves et al. |
| 6,418,678 | B2 | 7/2002 | Rotter |
| 6,439,466 | B2 | 8/2002 | Fikes |
| 6,447,390 | B1 | 9/2002 | O'Hagin |
| 6,453,629 | B1 | 9/2002 | Nakazima et al. |
| 6,491,579 | B1 | 12/2002 | O'Hagin |
| 6,501,013 | B1 | 12/2002 | Dinwoodie |
| 6,541,693 | B2 | 4/2003 | Takada et al. |
| 6,571,522 | B1 | 6/2003 | Perini |
| 6,606,828 | B1 | 8/2003 | Lin et al. |
| 6,606,830 | B2 | 8/2003 | Nagao et al. |
| 6,662,509 | B2 | 12/2003 | Sharp et al. |
| 6,662,510 | B2 | 12/2003 | Rotter |
| 6,695,692 | B1 | 2/2004 | York |
| 6,780,099 | B1 | 8/2004 | Harper |
| 6,799,742 | B2 | 10/2004 | Nakamura et al. |
| 6,870,087 | B1 | 3/2005 | Gallagher |
| 6,941,706 | B2 | 9/2005 | Austin et al. |
| 7,024,828 | B2 | 4/2006 | Headrick |
| 7,053,294 | B2 | 5/2006 | Tuttle et al. |
| 7,101,279 | B2 | 9/2006 | O'Hagin |
| 7,178,295 | B2 | 2/2007 | Dinwoodie |
| 7,250,000 | B2 | 7/2007 | Daniels, II |
| D549,316 | S | 8/2007 | O'Hagin et al. |
| 7,320,774 | B2 | 1/2008 | Simmons et al. |

(56) References Cited

U.S. PATENT DOCUMENTS

| | | | |
|---|---|---|---|
| 7,424,790 | B2 | 9/2008 | Austin et al. |
| 7,469,508 | B2 | 12/2008 | Ceria |
| 7,506,477 | B2 | 3/2009 | Flaherty et al. |
| 7,509,775 | B2 | 3/2009 | Flaherty et al. |
| 7,531,740 | B2 | 5/2009 | Flaherty et al. |
| 7,540,118 | B2 | 6/2009 | Jensen |
| 7,578,102 | B2 | 8/2009 | Banister |
| 7,587,864 | B2 | 9/2009 | McCaskill et al. |
| 7,618,310 | B2 | 11/2009 | Daniels |
| 7,642,449 | B2 | 1/2010 | Korman et al. |
| 7,678,990 | B2 | 3/2010 | McCaskill et al. |
| 7,736,940 | B2 | 6/2010 | Basol |
| 7,757,440 | B2 | 7/2010 | Austin et al. |
| 7,882,670 | B2 | 2/2011 | West |
| 7,901,278 | B2 | 3/2011 | O'Hagin |
| 8,112,945 | B2 | 2/2012 | Austin et al. |
| 9,140,013 | B2 | 9/2015 | Daniels |
| 10,105,559 | B2 | 10/2018 | Daniels |
| 2001/0027804 | A1 | 10/2001 | Inoue et al. |
| 2002/0086634 | A1 | 7/2002 | Seiis |
| 2003/0005649 | A1 | 1/2003 | Austin et al. |
| 2003/0159802 | A1 | 8/2003 | Steneby et al. |
| 2004/0098932 | A1 | 5/2004 | Broatch |
| 2005/0191957 | A1 | 9/2005 | Demetry et al. |
| 2002/0238394 | | 10/2005 | O'Hagin |
| 2005/0239393 | A1 | 10/2005 | Reese |
| 2005/0239394 | A1 | 10/2005 | O'Hagin et al. |
| 2005/0246972 | A1 | 11/2005 | Polumbus |
| 2006/0052047 | A1 | 3/2006 | Daniels |
| 2006/0052051 | A1 | 3/2006 | Daniels, II |
| 2006/0117695 | A1 | 6/2006 | Estes |
| 2006/0213767 | A1* | 9/2006 | Anaf ..... H01M 4/8605 204/268 |
| 2006/0240763 | A1 | 10/2006 | Takeda |
| 2007/0067063 | A1 | 3/2007 | Ahmed |
| 2007/0072541 | A1 | 3/2007 | Daniels et al. |
| 2007/0094953 | A1 | 5/2007 | Galeazzo et al. |
| 2007/0130850 | A1 | 6/2007 | Miekka |
| 2007/0173191 | A1 | 7/2007 | Daniels, II et al. |
| 2007/0207725 | A1 | 9/2007 | O'Hagin |
| 2007/0243820 | A1 | 10/2007 | O'Hagin |
| 2007/0275652 | A1 | 11/2007 | Berkompas |
| 2008/0098672 | A1 | 5/2008 | O'Hagin |
| 2008/0220714 | A1 | 9/2008 | Caruso |
| 2008/0299892 | A1 | 12/2008 | Robinson |
| 2009/0113817 | A1 | 5/2009 | Austin et al. |
| 2009/0203308 | A1 | 8/2009 | Daniels |
| 2009/0286463 | A1 | 11/2009 | Daniels |
| 2010/0227540 | A1 | 9/2010 | Smith |
| 2010/0229940 | A1 | 9/2010 | Basol |
| 2010/0325978 | A1 | 12/2010 | Montgomery |
| 2012/0073216 | A1 | 3/2012 | Daniels |
| 2012/0110924 | A1 | 5/2012 | Makin |

FOREIGN PATENT DOCUMENTS

| | | | |
|---|---|---|---|
| DE | 198 23 356 | 11/1999 | |
| FR | 2 324 823 | 4/1977 | |
| GB | 805978 | 12/1958 | |
| GB | 2 183 819 | 6/1987 | |
| GB | 2211287 A | 6/1989 | |
| GB | 2 279 453 | 1/1995 | |
| GB | 2 345 536 | 7/2000 | |
| JP | 59-60138 | 4/1984 | |
| JP | 06-241517 | 8/1994 | |
| JP | 06-272920 | 9/1994 | |
| JP | 09-158428 | 6/1997 | |
| JP | 10-061133 | 3/1998 | |
| JP | 11-044035 | 2/1999 | |
| JP | 11-229576 | 8/1999 | |
| JP | 2000-274032 | 10/2000 | |
| JP | 2004-092298 | 3/2004 | |
| JP | 2005-325592 | 5/2007 | |
| JP | 2007-534924 | 11/2007 | |
| WO | WO-9214971 A1 * | 9/1992 | ..... F23J 1/00 |
| WO | WO 01/40568 | 6/2001 | |
| WO | WO 2005/108708 | 11/2005 | |
| WO | WO2005/108708 | 11/2005 | |
| WO | WO 2011/126773 | 10/2011 | |

OTHER PUBLICATIONS

Chilengwe, Nelson. Optimising the airflow performance of ventilators for natural ventilation in buildings. Doctoral, Sheffield Hallam University (United Kingdom), 2005, pp. 244-245. (Year: 2005).*

Office Action dated Jan. 22, 2013 in Japanese Application No. 2011-509667, filed May 13, 2009.

Section 1203.2 of the 2007 California Building Code, Chapter 12.

"Building Materials Listing Program," Office of the State Fire Marshal—Fire Engineering—BML Program, http://osfm.fire.ca.gov/bml.html, Printed Feb. 27, 2008, 2 pages.

"Grill Screens," foodservicedirect.com, http://www.foodservicedirect.com/index.cfm/S/107/CLID/3362/N/9304/Grill Screens.html, Printed Feb. 29, 2008, 1 page.

International Search Report and Written Opinion dated Jun. 24, 2009, PCT Appl. No. PCT/US09/43838 filed May 13, 2009, 13 pages.

"Roof Battens," NASH—National Association of Steel-Framed Housing, http://www.nash.asn.au/whyChooseStStartOwnBuildRoofBatten.php, Printed Mar. 5, 2008, 2 pages.

"Stainless Steel Scrubber—Silver Color," foodservicedirect.com, http://www.foodservicedirect.com/index.cfm/S/107/CLID/3362/N/102336/Stainless Steel . . . , Printed Feb. 29, 2008, 1 page.

"Synthetic Roof Underlayment," ToolBase Services, http://www.toolbase.org/Technoloqy-Inventory/Roofs/synthetic-roof-underlayment, Printed Mar. 5, 2008, 3 pages.

"Tile Batten," http://www.metrollgld.com.au/minisites/products/tilebatten.html, Apr. 12, 2001, 2 pages.

"Wildland Urban Interface (WUI) Products," California Department of Forestry and Fire Protection—Office of the State Fire Marshall, Published by CAL-FIRE Wildland Fire Prevention Engineering, http://osfm.fire.ca.gov/pdf/fireengineering/bml/wuiproducts.pdf, Revised Dec. 28, 2007, 11 pages.

Office Action in Australian Patent Application No. 2009246322, filed May 13, 2009, dated Aug. 5, 2014.

Office Action in Japanese Patent Application No. 2011-509667, filed May 13, 2009, dated Aug. 26, 2014.

"Classic Chemistry Demonstrations," Compiled by Ted Lister, The Royal Society of Chemistry (1995).

Office Action in Malaysian Application No. PI 2010005332, filed May 13, 2009, dated Oct. 31, 2014.

"Burning Metal," Popular Science pp. 86 (Nov. 2007).

Notice of Acceptance in Australian Patent Application No. 2009246322, filed May 13, 2009, dated Dec. 8, 2014.

Notice of Allowance in Russian Patent Application No. 2010149942/12, filed May 13, 2009, dated May 23, 2014.

Advisory Action dated Nov. 14, 2008 in U.S. Appl. No. 11/736,498, filed Apr. 17, 2007.

Final Office Action dated Jul. 25, 2008 in U.S. Appl. No. 11/736,498, filed Apr. 17, 2007.

International Search Report dated Nov. 25, 2005 in corresponding International Application No. PCT/US2005/029918.

Office Action dated Dec. 26, 2008 in corresponding Malaysian Application No. PI 20054111.

Office Action dated Dec. 18, 2007 in U.S. Appl. No. 11/736,498, filed Apr. 17, 2007.

Office Action dated Dec. 23, 2008 in U.S. Appl. No. 11/736,498, filed Apr. 17, 2007.

Office Action dated Jul. 21, 2010 in U.S. Appl. No. 11/923,456, filed Oct. 24, 2007.

International Search Report and Written Opinion dated Nov. 5, 2012 in Application No. PCT/US2011/030027, filed Mar. 25, 2011.

Office Action in Russian Application No. 2010149942/12, filed May 13, 2009, dated Mar. 21, 2013.

Office Action in Russian Application No. 2010149942/12, filed May 13, 2009, dated Oct. 11, 2013.

(56) References Cited

OTHER PUBLICATIONS

Office Action in Australian Application No. 2009246322, filed May 13, 2009, dated Nov. 28, 2013.
Office Action dated Nov. 26, 2013 in Japanese Application No. 2011-509667, filed May 13, 2009.
Office Action in Philippines Application No. 2010/502554, filed May 13, 2009, dated May 28, 2015.
Office Action in Canadian Application No. 2724010, filed May 13, 2009, dated Apr. 30, 2015.
Office Action in Australian Application No. 2009246322, filed May 13, 2009, dated Aug. 5, 2014.
Office Action in Japanese Application No. 2011-509667, filed May 13, 2009, dated Aug. 26, 2014.
Office Action with cited references received in related application Australia Patent Application No. 2014277679, Filed: Dec. 16, 2014, Office Action dated Jan. 13, 2016.
Office Action received in related application Malaysia Patent Application No. PI2010005332, Filed: May 13, 2009, Office Action dated Oct. 31, 2014.
Office Action received in related application Canadian Patent Application No. 2,724,010, Filed: Nov. 13, 2010, Office Action dated Apr. 30, 2015.
European Search Report dated May 20, 2015 from related Application No. EP 09747505.7.
Office Action with cited references received Dec. 8, 2015, in related application Japanese Application No. 2014-238314.
Office Action in European Application No. 09747505.7, filed May 13, 2009, dated Dec. 16, 2016.
Office Action in Japanese Application No. 2014-238314, filed Nov. 26, 2014, dated Dec. 8, 2015.
Office Action received in related application European Application No. 09747505.7, Filed May 13, 2009, dated Jan. 3, 2019.
Office Action in European Patent Application No. 09747505.7, dated Oct. 10, 2017.
Office Action in Indian Patent Application No. 8859/DELNP/2010, dated Jan. 25, 2018.
Office Action in Japanese Application No. 2014-238314, dated Dec. 8, 2015.

* cited by examiner

FIG. 4A1
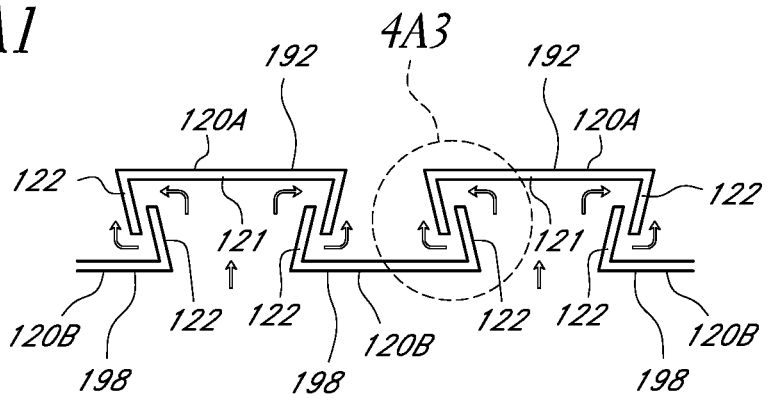
FIG. 4B
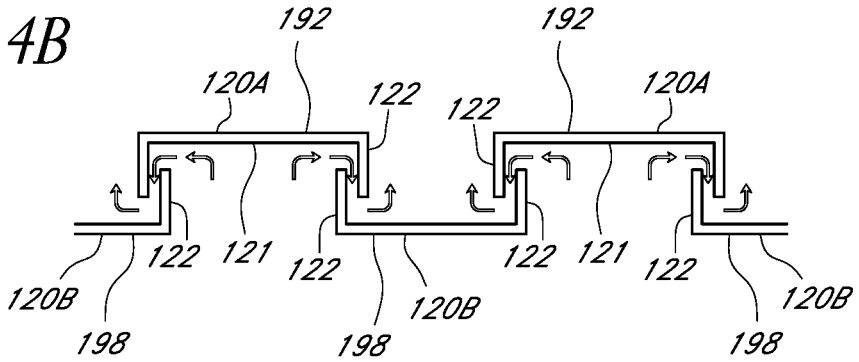
FIG. 4C
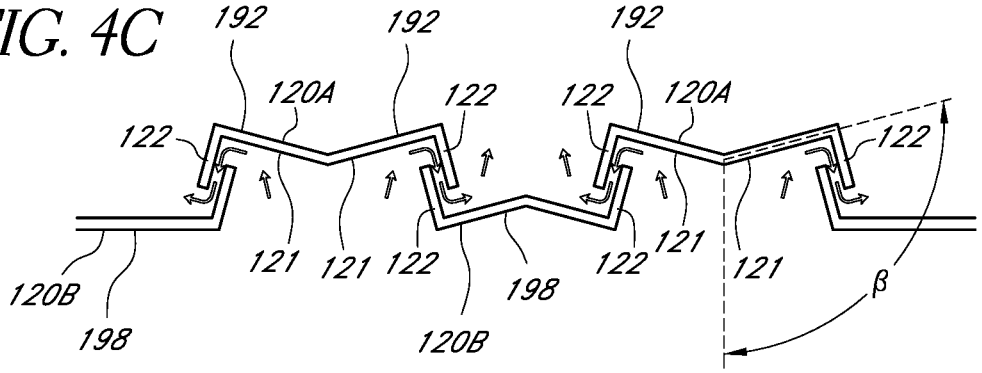
FIG. 4D
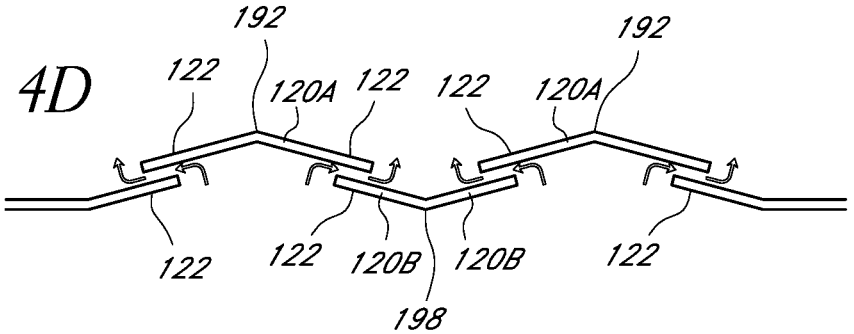

FIG. 4A2
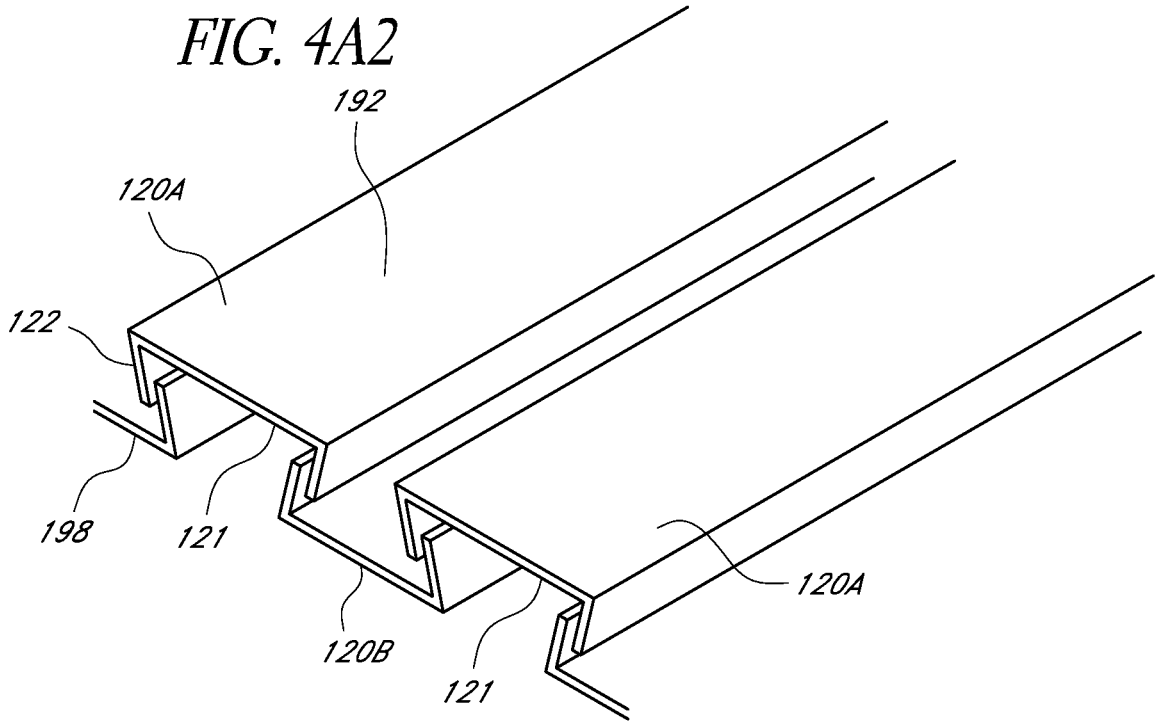
FIG. 4A3
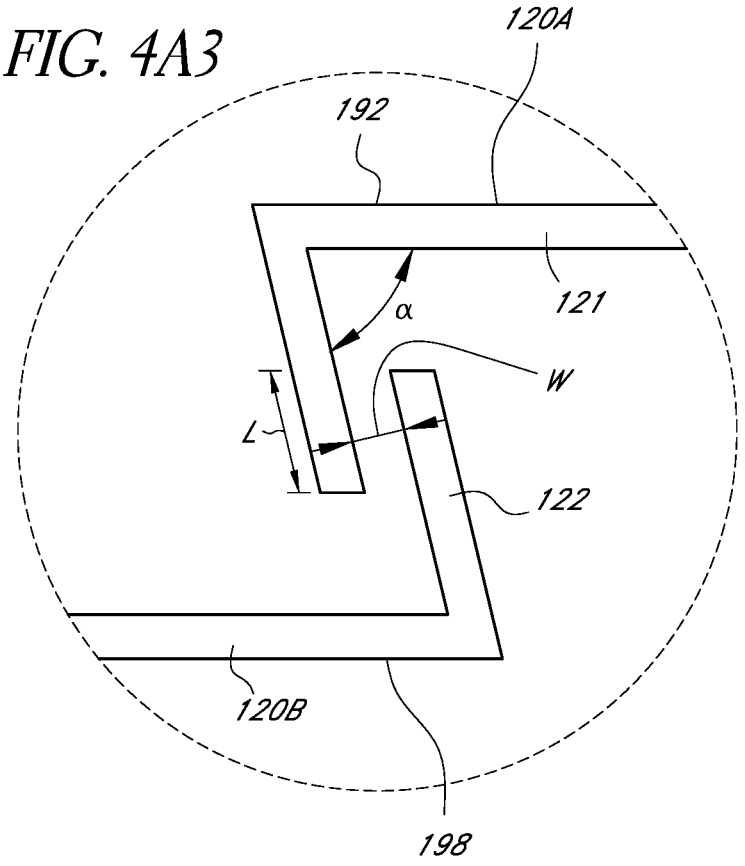

EMBER-RESISTANT AND FLAME-RESISTANT ROOF VENTILATION SYSTEM

CROSS-REFERENCE TO RELATED APPLICATIONS

This application claims the benefit of U.S. patent application Ser. No. 14/688,847, filed Apr. 16, 2015, entitled EMBER-RESISTANT AND FLAME-RESISTANT ROOF VENTILATION SYSTEM, which is a continuation and claims the benefit of U.S. patent application Ser. No. 12/465,236, filed May 13, 2009, entitled EMBER-RESISTANT AND FLAME-RESISTANT ROOF VENTILATION SYSTEM, now U.S. Pat. No. 9,011,221, issued on Apr. 21, 2015, which claims the benefit of U.S. Provisional Patent Application No. 61/052,862, filed May 13, 2008, entitled EMBER-RESISTANT AND FLAME-RESISTANT ROOF VENTILATION SYSTEM, the disclosures of which are incorporated herein by reference in their entirety.

INCORPORATION BY REFERENCE TO ANY PRIORITY APPLICATIONS

Any and all applications for which a foreign or domestic priority claims is identified in the Application Data Sheet as filed with the present application are hereby incorporated by reference under 37 C.F.C. § 1.57.

BACKGROUND OF THE INVENTION

Field of the Invention

This invention relates to ventilation systems, more particularly to roof ventilation systems that help to protect buildings against fires.

Description of the Related Art

Ventilation of a building has numerous benefits for both the building and its occupants. For example, ventilation of an attic space can prevent the attic's temperature from rising to undesirable levels, which also reduces the cost of cooling the interior living space of the building. In addition, increased ventilation in an attic space tends to reduce the humidity within the attic, which can prolong the life of lumber used in the building's framing and elsewhere by diminishing the incidence of mold and dry-rot. Moreover, ventilation promotes a more healthful environment for residents of the building by encouraging the introduction of fresh, outside air. Also, building codes and local ordinances typically require ventilation and dictate the amount of required ventilation. Most jurisdictions require a certain amount of "net free ventilating area," which is a well-known and widely used measure of ventilation.

An important type of ventilation is Above Sheathing Ventilation ("ASV"), which is ventilation of an area within a roof above the sheathing on a roof deck, such as in a batten cavity between the top of the roof deck and the underside of the tiles. Increasing ASV has the beneficial effect of cooling the batten cavity and reducing the amount of radiant heat that can transfer into the structure of the building, such as an attic space. By reducing the transfer of radiant heat into the building, the structure can stay cooler and require less energy for cooling (e.g., via air conditioners).

In many areas, buildings are at risk of exposure to wildfires. Wildfires can generate firebrands, or burning embers, as a byproduct of the combustion of materials in a wildfire. These embers can travel, airborne, up to one mile or more from the initial location of the wildfire, which increases the severity and scope of the wildfire. One way wildfires can damage buildings is when embers from the fire land either on or near a building. Likewise, burning structures produce embers, which can also travel along air currents to locations removed from the burning structures and pose hazards similar to embers from wildfires. Embers can ignite surrounding vegetation and/or building materials that are not fire-resistant. Additionally, embers can enter the building through foundation vents, under-eave vents, soffit vents, gable end vents, and dormer or other types of traditional roof field vents. Embers that enter the structure can encounter combustible materials and set fire to the building. Fires also generate flames, which can likewise set fire to or otherwise damage buildings when they enter the building's interior through vents.

SUMMARY OF THE INVENTION

A system is needed that provides adequate ventilation but protects the building against the ingress of flames, embers, ash, or other harmful floating materials. Desirably, the ventilation system should protect against the ingress of flames and/or embers while still meeting net free ventilation requirements.

The presently disclosed embodiments seek to address the issues discussed above by providing a roof vent that impedes the entry of flames and embers or other floating burning materials while still permitting sufficient air flow to adequately ventilate a building. In preferred embodiments, a roof vent includes an ember and/or flame impedance structure that substantially prevents the ingress of flames and floating embers through the vent. Embers can be as small as 3-4 mm in size. In preferred embodiments, such embers become trapped within the ember and/or flame impedance structure and extinguish naturally therein, without entering the building. In one aspect, the ember and/or flame impedance structure includes a baffle member. This structure also impedes flames inasmuch as the flames would have to traverse a circuitous route to pass through the baffle member. In another aspect, the ember impedance structure includes a fire-resistant fibrous interwoven material. In still another aspect, flame impedance is enhanced through a low profile vent design, which flames tend to pass over, in contrast to a high profile vent design (such as a dormer vent), which presents a natural entry point for flames.

Several configurations of baffle members are described. In some configurations, air flow from one side of the baffle member to the other must traverse a flow path including at least one turn of greater than 90 degrees. In addition, or as an alternative to such configurations, some configurations of baffle members provide a flow path including at least one passage having a width less than or approximately equal to 2.0 cm. The passage may have a length greater than or approximately equal to 0.9 cm.

In some embodiments, the vent system includes first and second vent members, with the first vent member permitting air flow through a hole or opening in a roof deck, and the second vent member taking the place of one or more roof cover elements (e.g., roof tiles adjacent the second vent member). The first and second vent members can be laterally displaced with respect to one another, such that flames and embers entering through the second vent member would have to traverse a flow path along the roof deck before encountering the first vent member. A fire resistant underlayment can also be provided overlying the roof deck to protect the roof deck from embers and flames. Further, supporting members, such as battens, creating an air permeable gap between the roof deck and the roof cover elements can be formed of a fire resistant material. In some embodiments, a third vent member can permit additional flow through a different hole in the roof deck, the third vent member optionally being substantially identical to the first vent member.

In other embodiments, first and second vent members can be joined to form an integrated one-piece vent. The one-piece vent may include a baffle member that prevents the ingress of flames and embers into the building. Alternately, the one-piece vent can include a fire-resistant mesh material that substantially prevents the ingress of floating embers through the vent. Such one-piece systems may be of particular use in so-called composition roofs formed of composite roof materials.

In accordance with one embodiment, a roof field vent is provided. The vent includes a first vent member comprising a first opening that permits air flow between a region below the roof and a region above the first vent member. The vent further includes a second vent member adapted to be in fluid communication with the region above the first vent member. The second vent member includes a second opening permitting air flow between regions above and below the second vent member. At least one of the first and second openings includes a baffle member, the baffle member substantially preventing the ingress of floating embers and/or flames, the baffle member configured to be oriented substantially parallel to a roof field when the vent is installed in the roof field.

In accordance with another embodiment, a roof field vent is provided. The vent includes a first vent member comprising a first opening that permits air flow between a region below the roof and a region above the first vent member. The vent further includes a second vent member adapted to be in fluid communication with the region above the first vent member. The second vent member includes a second opening permitting air flow between regions above and below the second vent member. The vent further includes an ember and/or flame impedance structure connected to one of the first and second vent members so that air flowing through one of the first and second openings flows through the ember and/or flame impedance structure. The ember and/or flame impedance structure includes an elongated upper baffle member comprising a top portion and at least one downwardly extending edge portion connected to the top portion, the top portion and the at least one downwardly extending edge portion being substantially parallel to a longitudinal axis of the upper baffle member. The ember and/or flame impedance structure further includes an elongated lower baffle member comprising a bottom portion and at least one upwardly extending edge portion connected to the bottom portion, the bottom portion and the at least one upwardly extending edge portion being substantially parallel to a longitudinal axis of the lower baffle member. The longitudinal axes of the upper and lower baffle members are substantially parallel to one another, and the edge portions of the upper and lower baffle members overlap to form a narrow passage therebetween, such that at least some of the air that flows through the ember and/or flame impedance structure traverses a circuitous path partially formed by the narrow passage.

In accordance with another embodiment, a roof segment is provided. The segment includes a portion of a roof deck comprising at least one roof deck opening. The segment further includes a first vent member installed in the roof deck at the roof deck opening, the first vent member including a first opening that permits air flow through the roof deck opening between a region below the roof and a region above the first vent member. The segment further includes a layer of roof cover elements positioned above the roof deck and engaging one another in a repeating pattern. The segment further includes a second vent member in fluid communication with the region above the first vent member, the second vent member including a second opening permitting air flow between regions above and below the second vent member, wherein the second vent member is positioned substantially within the layer of roof cover elements. At least one of the first and second openings includes a baffle member, the baffle member substantially preventing the ingress of floating embers and/or flames, the baffle member being oriented substantially parallel to the roof deck.

In accordance with another aspect, a roof vent is provided. The roof vent comprises a first vent member comprising a first opening that permits air flow between a region below a roof and a region above the first vent member. The roof vent also comprises a second vent member adapted to be in fluid communication with the region above the first vent member. The second vent member comprises a second opening permitting air flow between regions above and below the second vent member. At least one of the first and second vent members includes a fire-resistant mesh material that substantially prevents the ingress of floating embers through the first opening or the second opening.

In accordance with another aspect, a roof vent is provided, comprising first and second vent members. The first vent member comprises a first opening that permits air flow between a region below a roof and a region above the first vent member. The second vent member is adapted to be in fluid communication with the region above the first vent member. The second vent member comprises a second opening permitting air flow between regions above and below the second vent member. At least one of the first and second vent members includes an ember and/or flame impedance structure that substantially prevents the ingress of floating embers through the opening of the vent member.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular embodiment(s) disclosed.

BRIEF DESCRIPTION OF THE DRAWINGS

The appended drawings are schematic, not necessarily drawn to scale, and are meant to illustrate and not to limit embodiments of the invention.

FIG. 4A1 is a cross sectional view of one embodiment of baffle members for use in a roof ventilation system.

FIG. 4A2 is a schematic perspective view of a section of the baffle members shown in FIG. 4A1.

FIG. 4A3 is a detail of the cross sectional view shown in FIG. 4A1.

FIG. 4B is a cross sectional view of another embodiment of baffle members for use in a roof ventilation system.

FIG. 4C is a cross sectional view of another embodiment of baffle members for use in a roof ventilation system.

FIG. 4D is a cross sectional view of another embodiment of baffle members for use in a roof ventilation system.

DETAILED DESCRIPTION OF THE PREFERRED EMBODIMENTS

Figure 1:
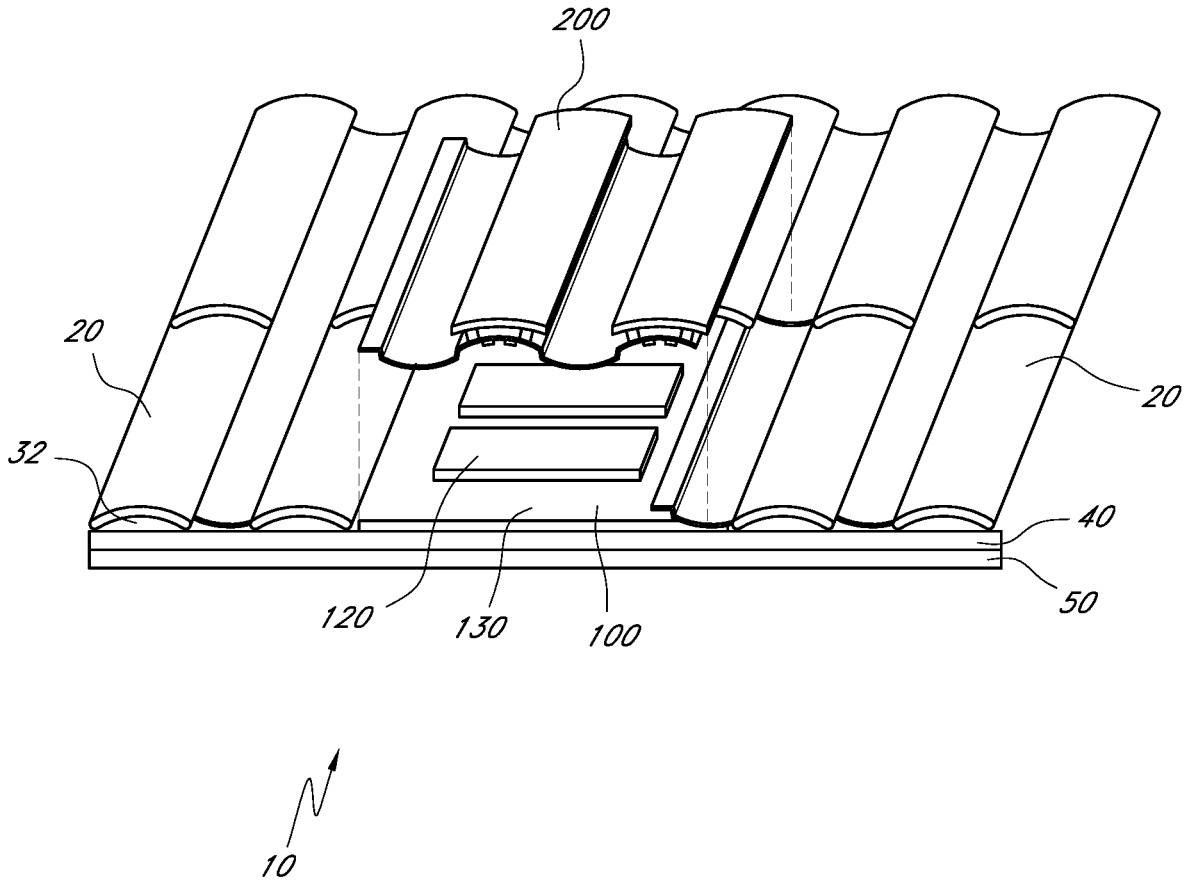
FIG. 1 is a schematic perspective view of a section of a roof including one embodiment of a roof ventilation system.

FIG. 1 is a schematic perspective view of a section of a roof including one embodiment of a roof ventilation system 10 with an ember and/or flame impedance structure. In particular, a two-piece vent system 10 is shown including a first vent member 100 and a second vent member 200. Examples of two-piece vent systems are described in U.S. Pat. Nos. 6,050,039 and 6,447,390, which are incorporated herein by reference in their entireties. With reference to FIG. 1, the first vent member 100 is sometimes referred to as a "subflashing" or "primary vent member," and the second vent member 200 is sometimes referred to as a "vent cover" or "secondary vent member." The second vent member 200 can rest upon the first vent member 100. In other embodiments, the second vent member 200 can engage surrounding roof tiles without contacting the first vent member 100. In such embodiments, the second vent member 200 may or may not be positioned above the first vent member 100, as described in further detail below. The second vent member 200 can be shaped to simulate the appearance of the surrounding roof cover elements 20, such as roof tiles, so that the vent system 10 visually blends into the appearance of the roof.

The first vent member 100 can rest upon a roof deck 50. In some embodiments, a protective layer 40, such as a fire resistant underlayment, can overlie the roof deck 50. Thus, the protective layer 40 can be interposed between the roof deck 50 and the first vent member 100, as shown in FIG. 1. In other configurations, the first vent member 100 is positioned on the roof deck 50 and the protective layer 40 overlies a portion of the first vent member 100, such that a portion of the first vent member 100 is interposed between the roof deck 50 and the protective layer 40. Fire resistant materials include materials that generally do not ignite, melt or combust when exposed to flames or hot embers. Fire resistant materials include, without limitation, "ignition resistant materials" as defined in Section 702A of the California Building Code, which includes products that have a flame spread of not over 25 and show no evidence of progressive combustion when tested in accordance with ASTM E84 for a period of 30 minutes. Fire resistant materials can be constructed of Class A materials (ASTM E-108, NFPA 256). A fire resistant protective layer appropriate for roofing underlayment is described in PCT App. Pub. No. 2001/40568 to Kiik et al., entitled "Roofing Underlayment," published Jun. 7, 2001, which is incorporated herein by reference in its entirety. In other embodiments, a non-fire resistant underlayment can be used in conjunction with a fire resistant cap sheet that overlies or encapsulates the underlayment. In still other embodiments, the protective layer 40 can be omitted.

In some embodiments, battens 30 (see FIGS. 5A & 6A) can be positioned above the roof deck 50, such as by resting on the protective layer 40, in order to support the cover elements 20 and to create an air permeable gap 32 (e.g., a "batten cavity") between the roof deck 50 and the cover elements 20. Battens configured to permit air flow through the battens ("flow-through battens") can be used to increase ASV. In some embodiments, the battens 30 can be formed of fire resistant materials. Examples of fire resistant materials that may be appropriate for use in battens include metals and metal alloys, such as steel (e.g., stainless steel), aluminum, and zinc/aluminum alloys. Alternately or in addition to employing fire resistant materials for the battens, the battens can be treated for fire resistance, such as by applying flame retardants or other fire resistant chemicals to the battens. Fire resistant battens are commercially available from Metroll of Richlands QLD, Australia.

The first vent member 100 includes a base 130 with an opening 110 (see FIGS. 3A, 3C, 5A & 5B) permitting air flow between a region below the roof deck 50 (e.g., an attic) and a region above the first vent member 100. In certain embodiments, the opening 110 is substantially rectangular (e.g., with dimensions of about 19"×7" or greater). Positioned within the opening 110 are one or more baffle members 120, which substantially prevent embers or flames from passing through the opening 110. As will be described in greater detail hereinbelow, in use, air can flow from a region below the roof deck 50 through the opening 110 and the baffle members 120 into the air permeable gap 32. From the air permeable gap 32, some air can pass through openings within and between roof cover elements 20. Air can also flow through openings 210 in the second vent member 200 (see FIG. 2) to a region above the second vent member 200. For simplicity and convenience, air flow paths are described herein as proceeding generally upwards from below the roof deck to the region above the roof. However, skilled artisans will understand that vent systems can also be configured to handle, even encourage, other flow paths, such as a generally downward air flow from the region above the roof to a region below the roof deck, for example by using fans associated with the roof vents. Some such configurations are described in U.S. Patent App. Pub. No. 2007/0207725, published Sep. 6, 2007, entitled "Apparatus and Methods for Ventilation of Solar Roof Panels," the entire disclosure of which is incorporated herein by reference.

Figure 2:
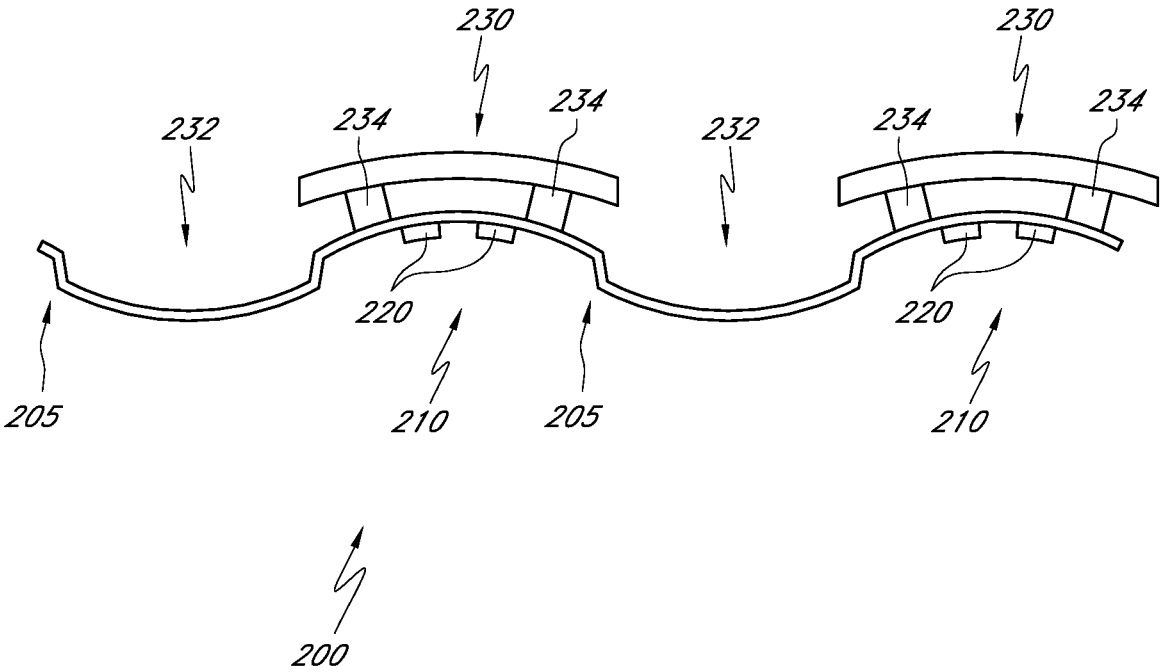
FIG. 2 is a front view of a second vent member of the roof ventilation system shown in FIG. 1.

FIG. 2 is a front view of the second vent member 200 shown in FIG. 1. The second vent member 200 can include cap sections 230 and pan sections 232. The second vent member 200 illustrated in FIG. 2 having cap sections 230 and pan sections 232 is configured for use in a roof having so-called "S-shaped" tiles, such that the cap sections 230 are aligned with the caps in adjacent upslope and downslope tiles and the pan sections 232 are aligned with the pans in adjacent upslope and downslope tiles. The cap sections 230 can be configured to shed rain water into the pan sections 232, and the pan sections 232 can funnel water down along an inclined roof. The cap sections 230 include covers 233 that can be supported by brackets 234, which create a space between the covers 233 and the body 205 of the second vent member 200 through which air can travel. While the embodiment illustrated in FIG. 2 is configured for use in a roof having S-shaped tiles, other embodiments can be configured to interact with roofs having other types of cover elements. For example, the second vent member 200 can also be configured to mimic the appearance of so-called "M-shaped" tiles or flat tiles.

The second vent member 200 also includes openings 210 permitting air flow between a region below the body 205 of the second vent member 200 (e.g., the air permeable gap 32) and a region above the second vent member 200. The openings 210 include one or more baffle members 220 that substantially prevent embers or flames from passing through the opening 210. The baffle members 220 can be configured in a similar fashion to the baffle members 120 in the first vent member 100. Further, in some embodiments, baffle members are included in only one of the openings 110, 210 because in some arrangements, one set of baffle members can be a sufficient safeguard against the intrusion of embers or flames.

Providing baffle members in the openings 110, 210 can have the effect of reducing the flow rate of air through the openings 110, 210. The goal of preventing the ingress of embers or flames into the building should be balanced against the goal of providing adequate ventilation. One way of striking this balance is to provide baffle members in only one of the openings 110, 210. In some arrangements in which baffle members are present in only one of the openings 110, 210, the first vent member 100 can be laterally displaced with respect to the second vent member 200, such as by positioning the first vent member 100 upslope or downslope from the second vent member 200 (See FIG. 6A). Such arrangements can provide an extra hindrance against the intrusion of embers or flames through the vent system 10 because embers or flames that pass through the second vent member 200 must additionally travel along the roof deck 50 through the air gap 32 for a certain distance before encountering the first vent member 100. Forcing embers or flames to flow upslope may be particularly effective in preventing their ingress.

Because the baffle members 120, 220 can constitute a flow restriction, the first and second vent members 100, 200 may need to be rebalanced to account for the modified flow characteristics. For example, in one arrangement, the first vent member 100 includes baffle members 120 but the second vent member 200 is free of baffles to permit additional air flow through the second vent member 200. Because the second vent member 200 may permit greater air flow than the first vent member 100 in such embodiments, an additional first vent member 100 may be positioned at a further opening in the roof deck 50. The additional first vent member 100 may also include one or more baffle members 120. The second vent member 200 may fluidly communicate with both of the first vent members 100, such as by receiving air that reached the second vent member 200 from both of the first vent members 100 via the air permeable gap 32 in an "open system," as discussed below with respect to FIGS. 5A and 5B. In other embodiments, it may be desirable to include more second vent members 200 than first vent members 100, for example when the first vent member 100 permits greater air flow than the second vent member 200.

Figure 3A:
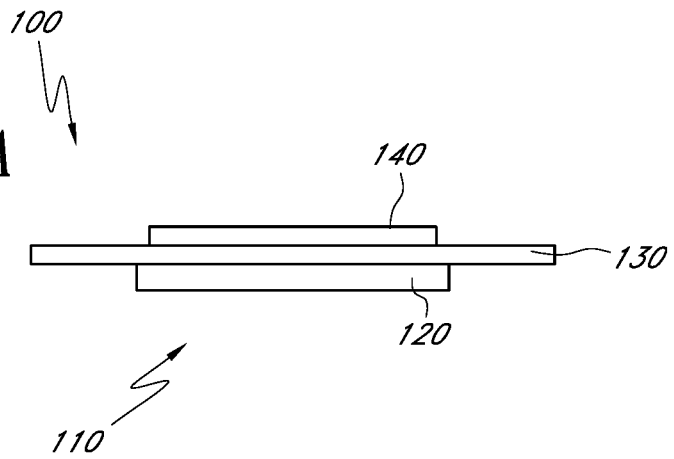
FIG. 3A is a front view of a first vent member of the roof ventilation system shown in FIG. 1.
Figure 3B:
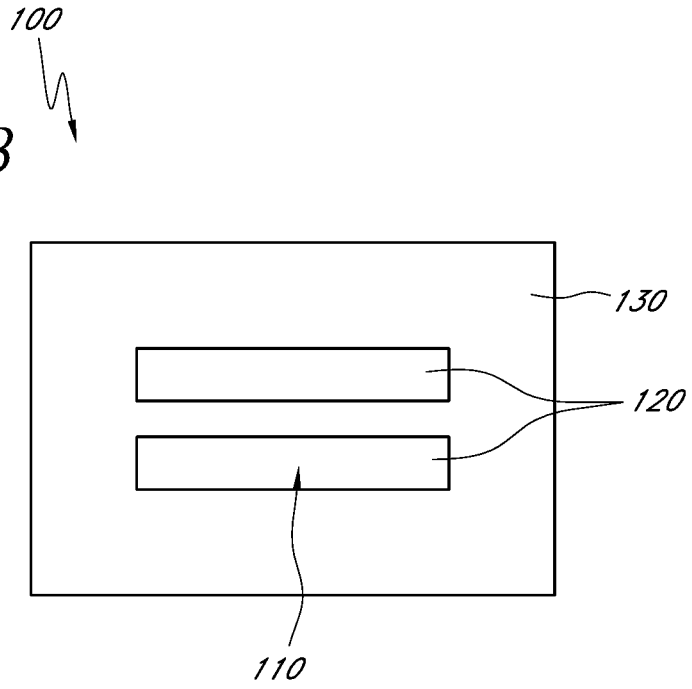
FIG. 3B is a bottom view of the first vent member shown in FIG. 3A.
Figure 3C:
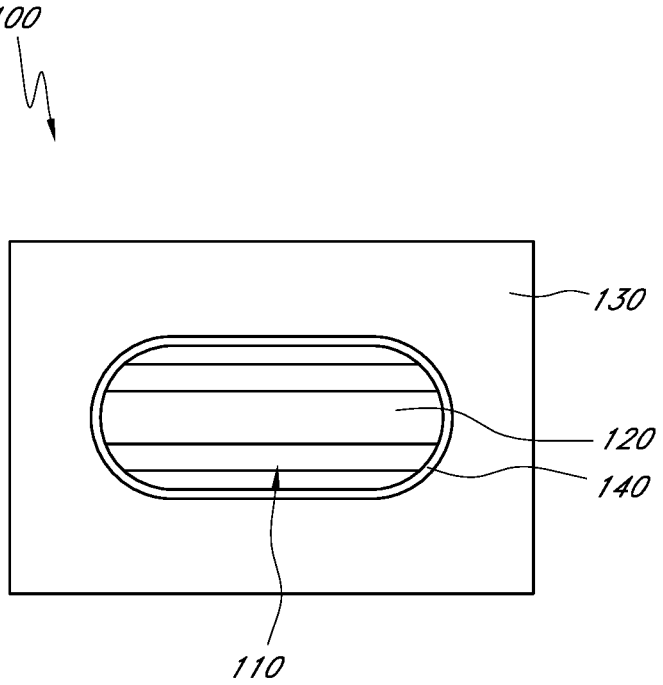
FIG. 3C is a top view of the first vent member shown in FIG. 3A.
Figure 3D:
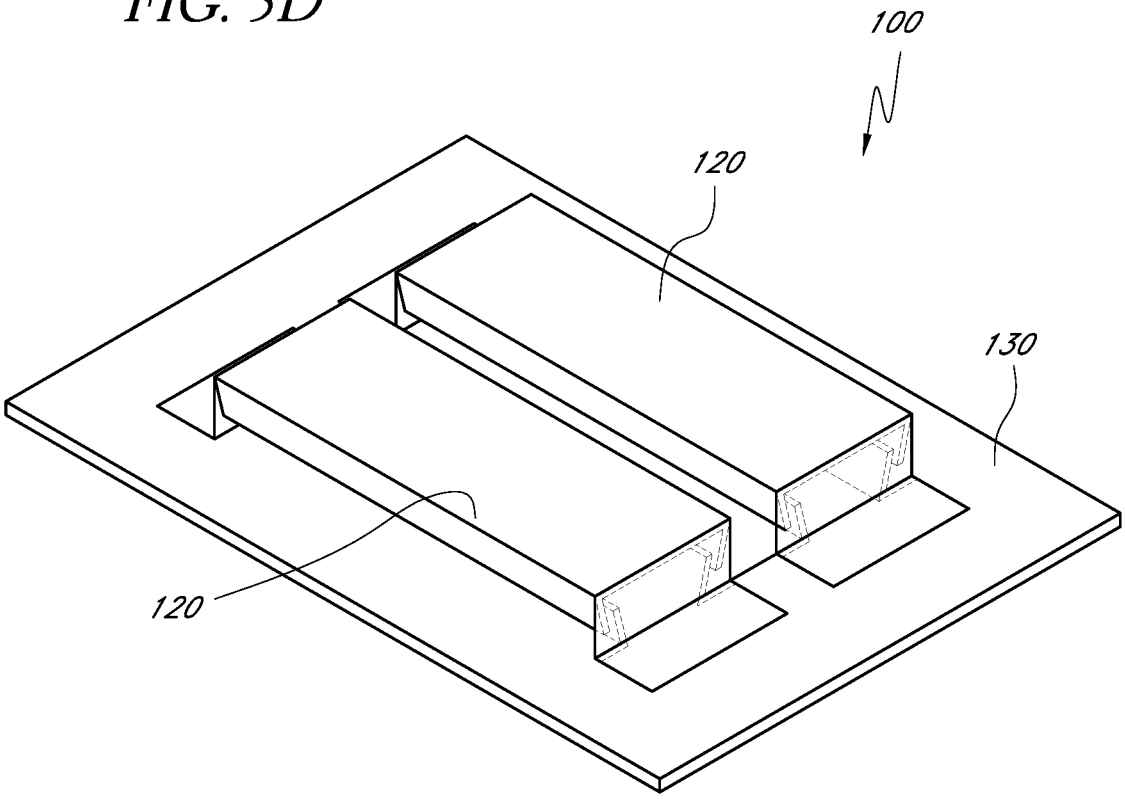
FIG. 3D is a bottom perspective view of the first vent member shown in FIG. 3A.

FIGS. 3A-3D illustrate several views of the first vent member 100 shown in FIG. 1. The first vent member 100 includes a base 130 that can rest on or above the roof deck 50, such as on the protective layer 40 (see FIG. 1). In some embodiments, the base 130 is generally planar, while in other embodiments, such as when the roof deck is non-planar, the base can be non-planar. The opening 110 in the first vent member 100 permits air flow through a hole in the roof deck 50. The opening 110 can include baffle members 120. As shown in FIG. 3D, the baffle members 120 can be connected at their ends to the generally planar member 130. As shown in FIGS. 3A and 3C, the first vent member 100 can include a flange 140 extending upward from the generally planar member 130. The flange 140 can prevent water flowing along the roof deck 50 (e.g., over the protective layer 40) from entering the opening 110.

In some embodiments, the first vent member 100 shown in FIGS. 3A-3D may be positioned upside-down, such that the flange 140 extends downward from the generally planar member 130. In such an arrangement, the flange 140 can aid in positioning the first vent member through the hole in the roof deck 50. In other embodiments, the baffle members can be positioned on the same side of the generally planar member as the flange, such that the baffle members are located inside the flange. In still other embodiments, two flanges are present in the first vent member, one extending upward to prevent the ingress of rain water and another extending downward to aid in positioning of the first vent member 100.

FIGS. 4A1-4D show cross sections of several exemplary baffle members 120. Although the baffle members in FIGS. 4A1-4D are labeled as baffle members 120 for convenience, the baffle members in FIGS. 4A1-4D can be used in vent systems 10 as baffle members 120 and/or baffle members 220 (i.e., the illustrated baffle members can be provided in the first vent member 100, the second vent member 200, or both). Further, the arrows shown in FIGS. 4A1-4D illustrate the flow paths of air passing from beneath the baffle members 120 to above the baffle members 120. Embers or flames above the baffle member 120 would have to substantially reverse one of the illustrated flow paths in order to pass through the illustrated baffle members 120.

The baffle members 120 can be held in their positions relative to each other through their connection with the generally planar member 130 at the end of the baffle members 120 (see FIG. 3D). Similarly, the baffle members 220 can be held in their positions relative to each other through their connection with the body 205 of the second vent member 200. Accordingly, the baffle members 120, 220 need not directly contact other baffle members, thus providing a substantially uniform flow path between the baffle members.

In the embodiment shown in FIG. 4A1-4A3, air flowing through the baffle members 120 encounters a web 121 of a baffle member 120, then flows along the web 121 to a passage between flanges or edge portions 122 of the baffle members 120. As shown in FIG. 4A3, air flowing from one side of the baffle members 120 traverses a passage bounded by the flanges 122 having a width W and a length L. In some embodiments, W can be less than or approximately equal to 2.0 cm, and is preferably within 1.7-2.0 cm. In some embodiments, L can be greater than or approximately equal to 2.5 cm (or greater than 2.86 cm), and is preferably within 2.5-6.0 cm, or more narrowly within 2.86-5.72 cm. Also, with reference to FIG. 4A3, the angle $\alpha$ between the webs 121 and the flanges 122 is preferably less than 90 degrees, and more preferably less than 75 degrees.

FIG. 4B illustrates a configuration similar to FIG. 4A except that the angle $\alpha$ between the flanges 122 and the web 121 is less severe, such as approximately 85-95 degrees, or approximately 90 degrees. Because the embodiment shown in FIG. 4B requires a less severe turn in the flow path through the baffle members 120, the embodiment of FIG. 4B may be more conducive to greater air flow than the embodiment shown in FIG. 4A.

In the embodiment shown in FIG. 4C, air flowing perpendicularly to the plane of the roof deck and then through the baffle members 120 encounters the web 121 at an angle $\theta$ that is more than 90 degrees (e.g., 90-110 degrees) before flowing into the passages between the flanges 122. The angled web 121 may help to direct the flow of air into the passages between the flanges 122. The angle $\alpha$ between the webs 121 and the flanges 122 in FIG. 4C is preferably between 45 degrees and 135 degrees, and more preferably between 75 degrees and 115 degrees.

The embodiment shown in FIG. 4D employs a V-design for the baffles 120. Air encounters the underside of an inverted V-shaped baffle member 120, then flows through passages between adjacent baffle members 120.

With reference to FIGS. 4A-4D, ember and/or flame impedance structures are shown that include elongated upper baffle members 120A and elongated lower baffle members 120B. The elongated upper baffle members 120A can include top portions 192 and downwardly extending edge portions 122 that are connected to the top portions 192. In the embodiments shown in FIGS. 4A-4D, the top portions 192 and the downwardly extending edge portions 122 are substantially parallel to a longitudinal axis of the upper baffle member 120A. The elongated lower baffle members 120B can include bottom portions 198 and upwardly extending edge portions 122 that are connected to the bottom portions 198. In the embodiments shown in FIGS. 4A-4D, the bottom portions 198 and the upwardly extending edge portions 122 are substantially parallel to a longitudinal axis of the lower baffle member 120B.

Further, in the embodiments shown in FIGS. 4A-4D, the longitudinal axes of the upper and lower baffle members 120A, 120B are substantially parallel to one another, and the edge portions 122 of the upper and lower baffle members overlap to form a narrow passage therebetween, such that at least some of the air that flows through the ember and/or flame impedance structure traverses a circuitous path partially formed by the narrow passage. In some embodiments, the at least one narrow passage extends throughout a length of one of the upper and lower baffle members. The at least one narrow passage can extend throughout a length of one of the upper and lower baffle members, and it may have a width less than or equal to 2.0 cm, and a length greater than or equal to 2.5 cm. In some embodiments, the longitudinal axes of the upper and lower baffle members 120A, 120B are each configured to be substantially parallel to the roof field when the vent is installed within the roof field.

In some embodiments, such as shown in FIGS. 4A-4B, the upper baffle member 120A includes a pair of downwardly extending edge portions 122 connected at opposing sides of the top portion 192. Further, the lower baffle member 120B can include a pair of upwardly extending edge portions 122 connected at opposing sides of the bottom portion 198. The vent can also include a second elongated upper baffle member 120A configured similarly to the first elongated upper baffle member 120A and having a longitudinal axis that is substantially parallel to the longitudinal axis of the first upper baffle member 120A. One of the edge portions 122 of the first upper baffle member 120A and a first of the edge portions 122 of the lower baffle member 120B can overlap to form a narrow passage therebetween. Further, one of the edge portions 122 of the second upper baffle member 120A and a second of the edge portions 122 of the lower baffle member 120B can overlap to form a second narrow passage therebetween, such that at least some of the air flowing through the ember and/or flame impedance structure traverses a circuitous path partially formed by the second narrow passage.

In some embodiments, the lower baffle member 120B includes a pair of upwardly extending edge portions 122 connected at opposing sides of the bottom portion 198. Further, the upper baffle member 120A can include a pair of downwardly extending edge portions 122 connected at opposing sides of the top portion 192. The vent can also include a second elongated lower baffle member 120B configured similarly to the first elongated lower baffle member 120B and having longitudinal axis that is substantially parallel to the longitudinal axis of the first lower baffle member 120B. One of the edge portions 122 of the first lower baffle member 120B and a first of the edge portions 122 of the upper baffle member 120A can overlap to form a narrow passage therebetween. Further, one of the edge portions 122 of the second lower baffle member 120B and a second of the edge portions 122 of the upper baffle member 120A can overlap to form a second narrow passage therebetween, such that at least some of the air flowing through the ember and/or flame impedance structure traverses a circuitous path partially formed by the second narrow passage.

Although FIGS. 4A-4D illustrate some examples of baffle members that may substantially prevent the ingress of embers or flames, skilled artisans will recognize that the efficacy of these examples for preventing the passage of embers or flames will depend in part on the specific dimensions and angles used in the construction of the baffle members. For example, in the embodiment shown in FIG. 4D, the baffle members 120 will be more effective at preventing the ingress of embers or flames if the passages between the baffle members 120 are made to be longer and narrower. However, longer and narrower passages will also slow the rate of air flow through the baffle members. Skilled artisans will appreciate that the baffle members should be constructed so that the ingress of embers or flames is substantially prevented but reduction in air flow is minimized.

The baffle members cause air flowing from one side of the baffle member to another side to traverse a flow path. In some embodiments, such as the configurations shown in FIGS. 4A and 4D, the flow path includes at least one turn of greater than 90 degrees. In other embodiments, the flow path includes at least one passage having a width less than or approximately equal to 2.0 cm, or within 1.7-2.0 cm. For example, FIG. 4A3 illustrates a passage width W that preferably meets this numerical limitation. The length of the passage having the constrained width may be greater than or approximately equal to 2.5 cm, and is preferably within 2.5-6.0 cm. FIG. 4A3 illustrates a passage length L that preferably meets this numerical limitation.

Figure 13:
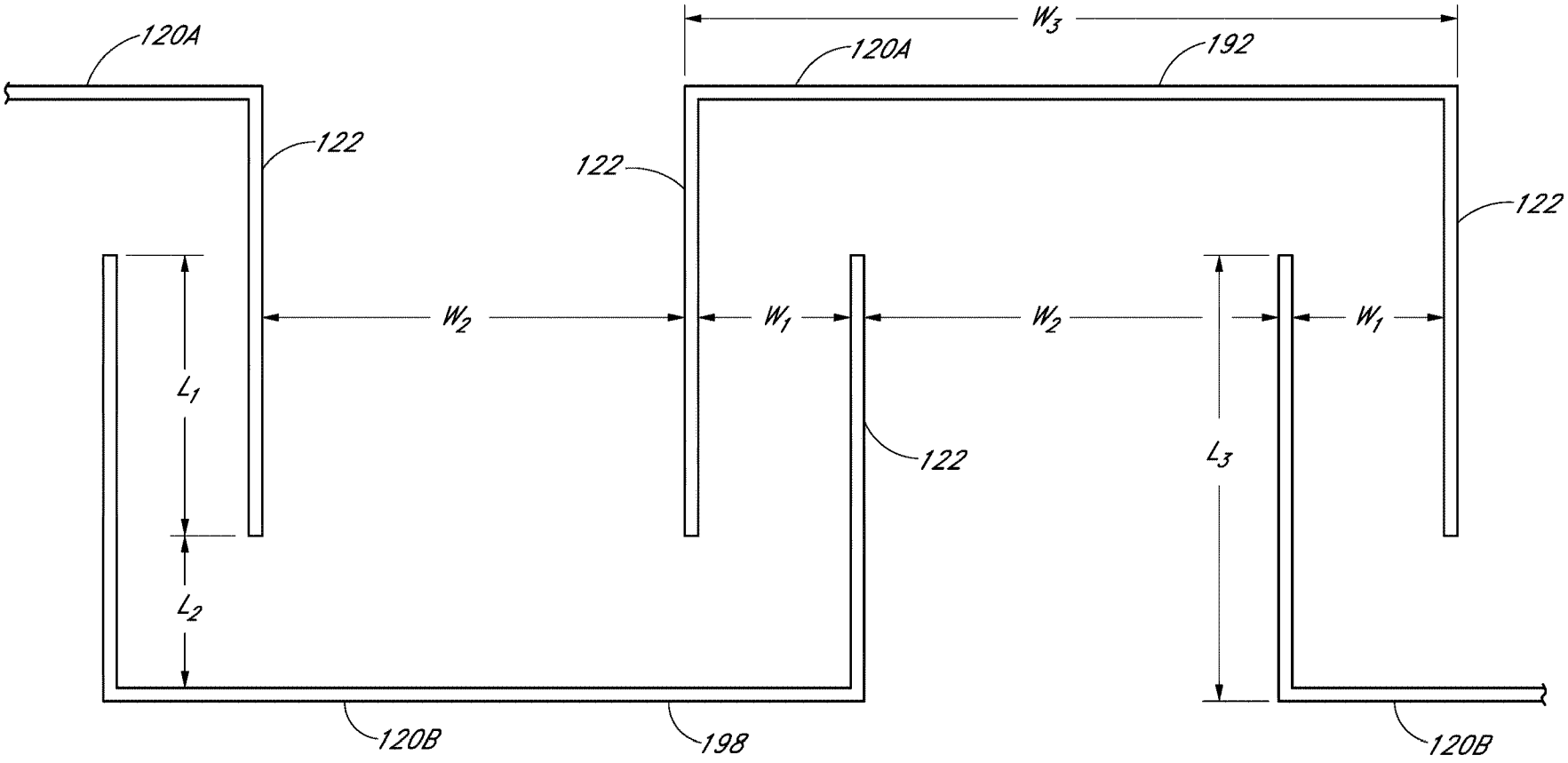
FIG. 13 is a cross sectional view of another embodiment of baffle members for use in a roof ventilation system.

A test was conducted to determine the performance of certain configurations of baffle members 120 that were constructed according to the embodiment illustrated in FIG. 13, which is similar to the embodiment illustrated in FIG. 4B. In the test, vents having different dimensions were compared to one another. In each of the vents tested, the width $W_1$ was held to be the same as the length $L_2$, and the width $W_2$ was held to be the same as the length $L_3$. Also, the upper and lower baffle members 120A and 120B were constrained to have the same size and shape as one another.

Figure 14A:
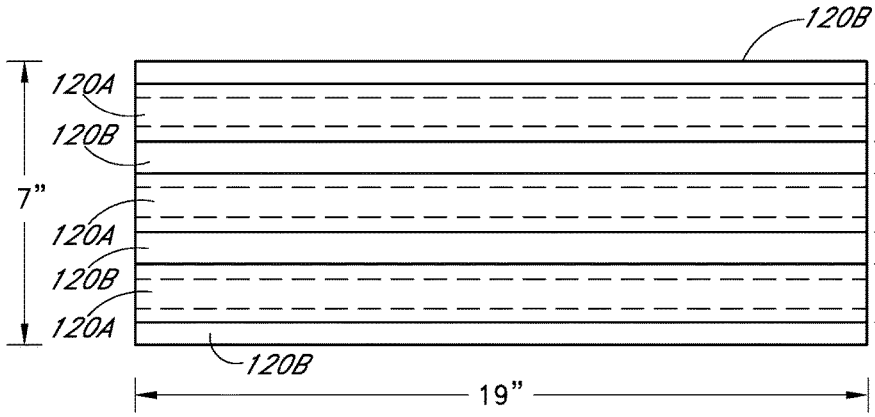
FIG. 14A is a top view of a vent for use in a roof ventilation system.
Figure 14D:
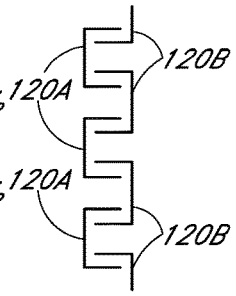
FIG. 14D is a cross sectional side view of the shown in FIG. 14A.
Figure 14B:
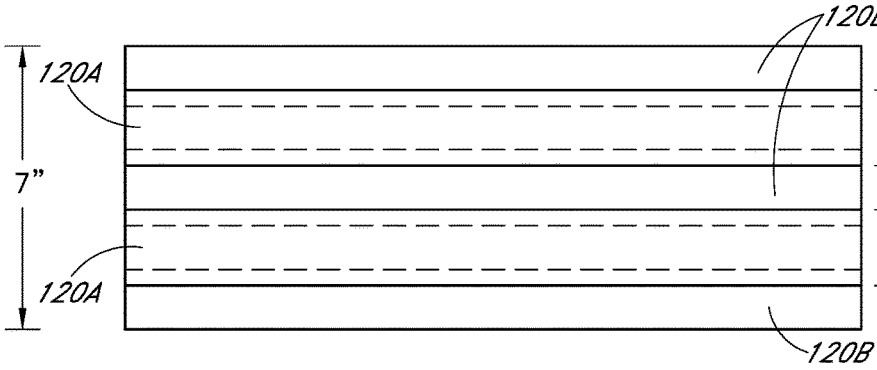
FIG. 14B is a top view of another vent for use in a roof ventilation system.
Figure 14E:
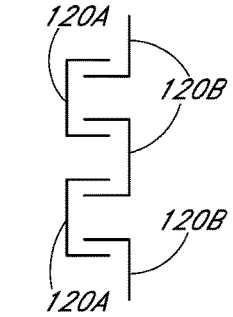
FIG. 14E is a cross sectional side view of the shown in FIG. 14B.
Figure 14C:
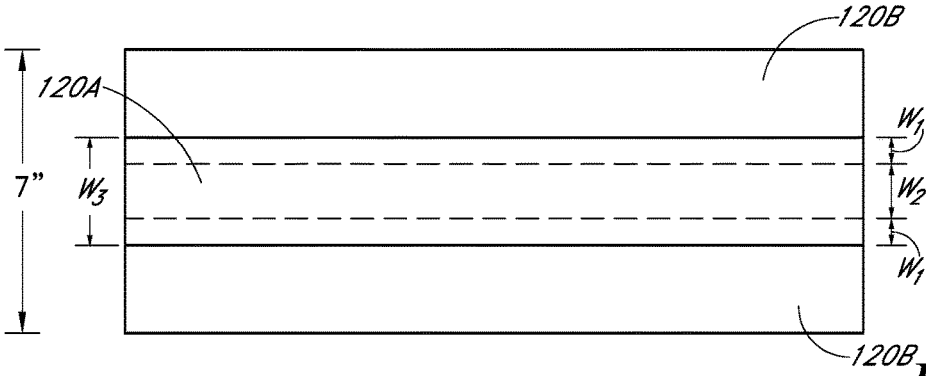
FIG. 14C is a top view of another vent for use in a roof ventilation system.
Figure 14F:
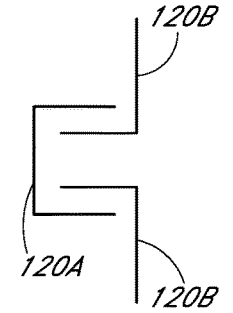
FIG. 14F is a cross sectional side view of the shown in FIG. 14C.

FIGS. 14A-C show a top view of the vents tested, and FIGS. 14D-F show a cross sectional side view of the vents shown in FIGS. 14A-C. As shown in FIGS. 14A-C, all three vents had outside dimensions of 19"×7". Because different dimensions were used for the baffle members 120 in the three vents tested, each vent included a different number of baffle members 120 in order to maintain the outside dimensions constant at 19"×7". FIGS. 14A and 14D show a first tested vent in which $W_1$=0.375", $W_2$=0.5" and $W_3$=1.5". FIGS. 14B and 14E show a second tested vent in which $W_1$=0.5", $W_2$=1.0" and $W_3$=2.0". FIGS. 14C and 14F show a third tested vent in which $W_1$=0.75", $W_2$=1.5" and $W_3$=3.0".

The test setup included an ember generator placed over the vent being tested, and a combustible filter media was positioned below the tested vent. A fan was attached to the vent to generate an airflow from the ember generator and through the vent and filter media. One hundred grams of dried pine needles were placed in the ember generator, ignited, and allowed to burn until extinguished, approximately two and a half minutes. The combustible filter media was then removed and any indications of combustion on the filter media were observed and recorded. The test was then repeated with the other vents. Table 1 below summarizes the results of the test, as well as the dimensions and net free vent area associated with each tested vent. Net free vent area is discussed in greater detail below, but for the purposes of the tested vents, the net free vent area is calculated as the width $W_1$ of the gap between the flanges 122 of adjacent baffle members 120, multiplied by the length of the baffle members 120 (which is 19" for each of the tested vents), multiplied further by the number of such gaps.

TABLE 1

| Test Vent | $W_1$ (in) | $W_2$ (in) | $W_3$ (in) | $L_1$ (in) | $L_2$ (in) | $L_3$ (in) | NFVA (sq. in.) | Observations of Filter Media After Test |
|---|---|---|---|---|---|---|---|---|
| 1 | 0.375 | 0.55 | 1.5 | 0.375 | 0.375 | 0.75 | 42.75 | Slight discoloration, three small burn holes. |
| 2 | 0.5 | 1.0 | 2.0 | 0.5 | 0.5 | 1.0 | 38 | Heavy discoloration, one large burn hole, five small burn holes. |
| 3 | 0.75 | 1.5 | 3.0 | 0.75 | 0.75 | 1.5 | 28.5 | No discoloration, one small burn hole. Extinguished embers visible. |

Each of the tested vents offered enhanced protection against ember intrusion, as compared to a baseline setup in which the tested vents are replaced with a screened opening. The results in Table 1 indicate that the first tested vent had improved performance for prevention of ember intrusion relative to the second tested vent. Moreover, the first tested vent also had a higher net free vent area than the second tested vent.

The results in Table 1 also indicate that the third tested vent offers the best performance for prevention of ember intrusion. It is believed that this is due in part to the fewer number of gaps between adjacent baffle members 120 that were present in the third tested vent, which restricted the paths through which embers could pass. Another factor believed to contribute to the ember resistance of the third tested vent is the greater distance embers had to travel to pass through the vent by virtue of the larger dimensions of the baffle members 120, which may provide a greater opportunity for the embers to extinguish. The third tested vent had the lowest net free vent area. The results indicate that a vent having a configuration similar to the third tested vent but having still larger dimensions (e.g., $W_1$=1.0", $W_2$=2.0", $W_3$=4.0") would maintain the ember intrusion resistance while increasing the net free vent area relative to the third tested vent. The upper bounds for the dimensions of the baffle member will depend on the type of roof on which the vent is employed, the size of the roof tiles, and other considerations.

As noted elsewhere in this application, the goal of preventing ember intrusion must be balanced against the goal of providing adequate ventilation. The results of this test indicate that, for a vent configured in the manner illustrated in FIG. 13, a vent having larger baffle members and fewer openings offers greater protection from embers but reduces the net free vent area. Thus, in some circumstances, more than one such vent may be needed to provide adequate ventilation. The results of the test also indicate that, for a vent configured in the manner illustrated in FIG. 13, a vent having smaller baffle members with a greater number of openings can provide greater net free vent area and enhanced ember protection relative to a vent with mid-sized baffle members and fewer openings.

Figure 5A:
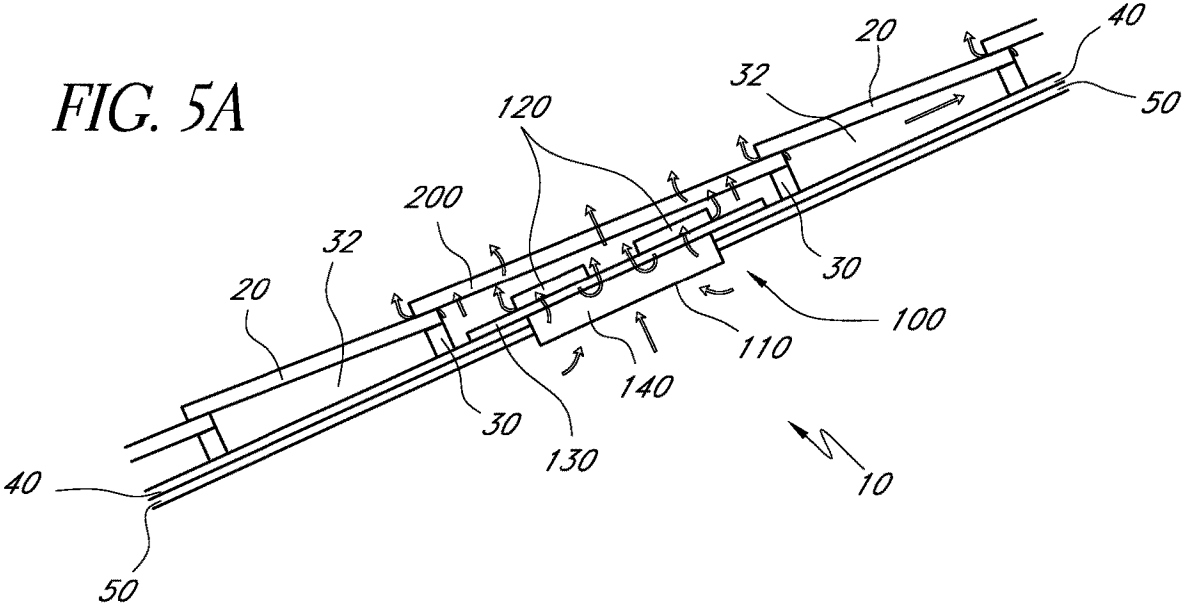
FIG. 5A is a schematic cross-sectional view of a roof section including one embodiment of a ventilation system.
Figure 5B:
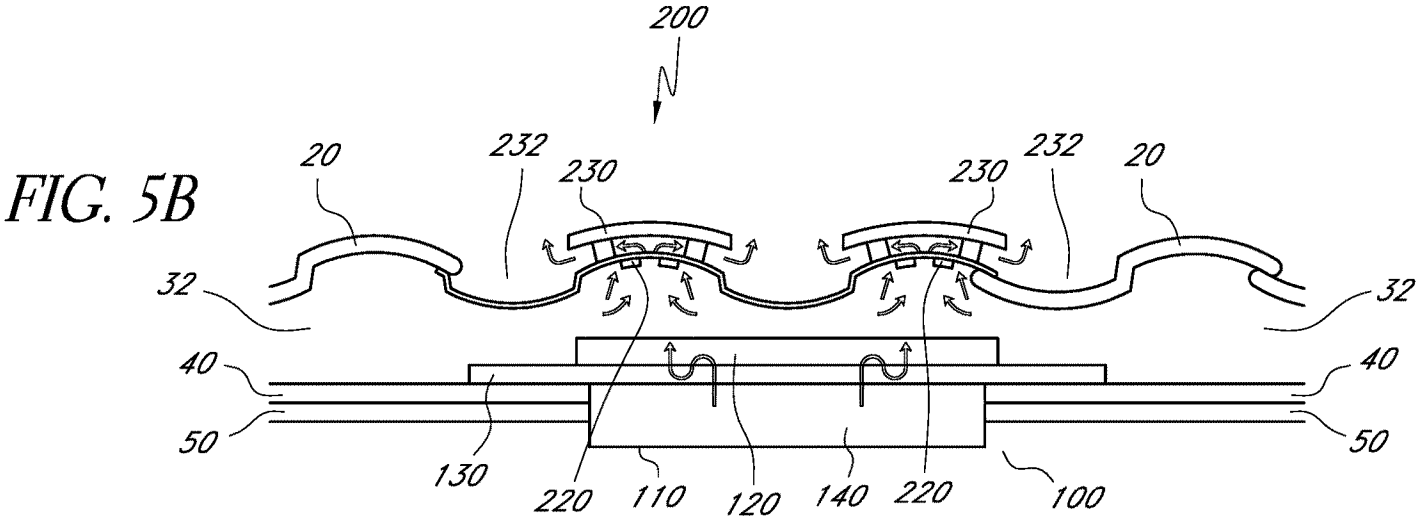
FIG. 5B is another schematic cross-sectional view of the roof section shown in FIG. 5A.

FIGS. 5A and 5B illustrate the air flow in a two-piece vent system 10 as described with reference to FIGS. 1-3D. As used herein, a "two-piece vent" includes vents in which one piece is secured or connected to a roof deck and another piece is positioned within a layer of cover elements (e.g., roof tiles), and the two pieces are not secured to one another. As used herein, a "one-piece vent" includes a vent consisting of one integrally formed piece or, alternatively, a vent in which two or more separate pieces are secured to one another (e.g., FIG. 7). FIG. 5A is a cross sectional view of a sloped roof along the sloped direction. Battens 30 traverse the roof in a direction substantially parallel to the roof's ridge and eave and support the cover elements 20. The battens 30 separate the cover elements 20 from the roof deck 50, thereby providing the air permeable gap 32. FIG. 5B is a cross sectional view of the roof along the direction perpendicular to the sloped direction (i.e., parallel to the roof's ridge and eave). In the embodiment shown in FIGS. 5A and 5B, the second vent member 200 is positioned substantially directly above the first vent member 100. FIGS. 5A and 5B illustrate an "open system," which advantageously permits air flow throughout the air permeable gap 32 (which will be understood to extend substantially throughout some or all of a roof field, as opposed to being limited to the immediate vicinity of a particular vent 10) as well as, in certain embodiments, through gaps between the cover elements 20, such that some air may exit the air permeable gap 32 without flowing through the secondary vent member 200. One example of a roof ventilation system that employs an open system is U.S. Pat. No. 6,491,579 to Harry O'Hagin, the entirety of which is incorporated herein by reference.

Figure 6A:
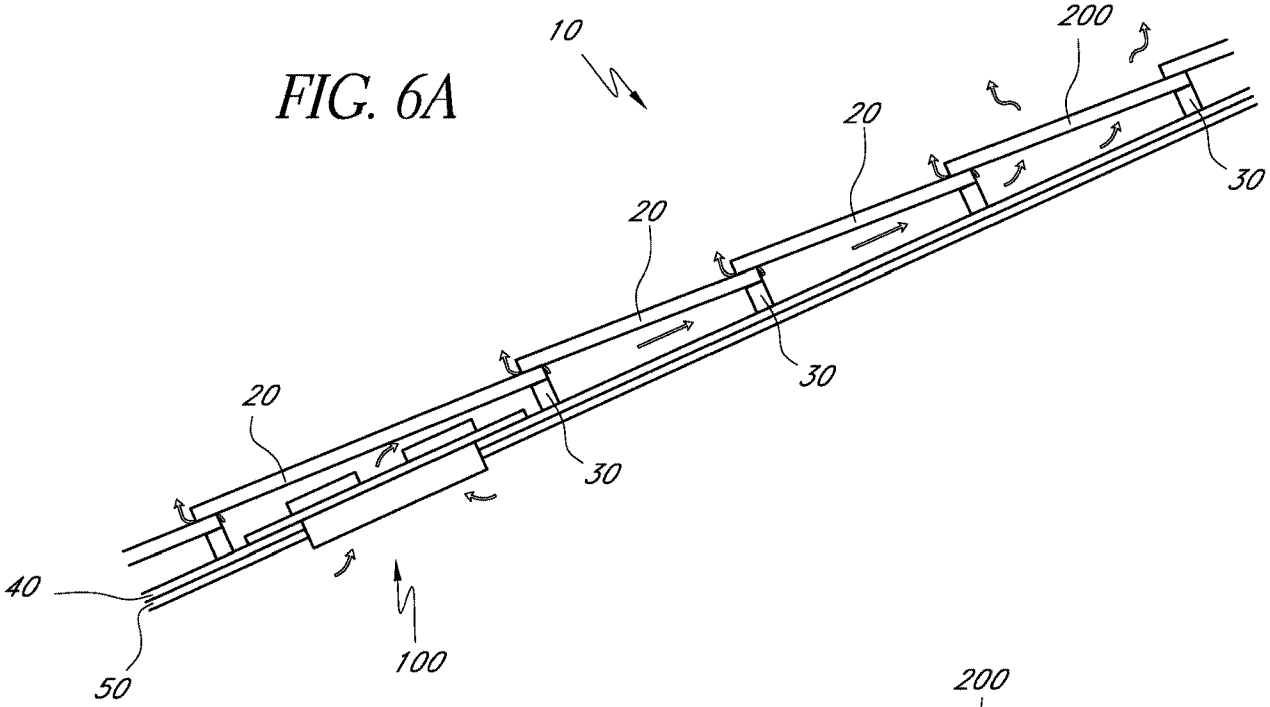
FIG. 6A is a schematic cross-sectional view of a roof section including another embodiment of a ventilation system.
Figure 6B:
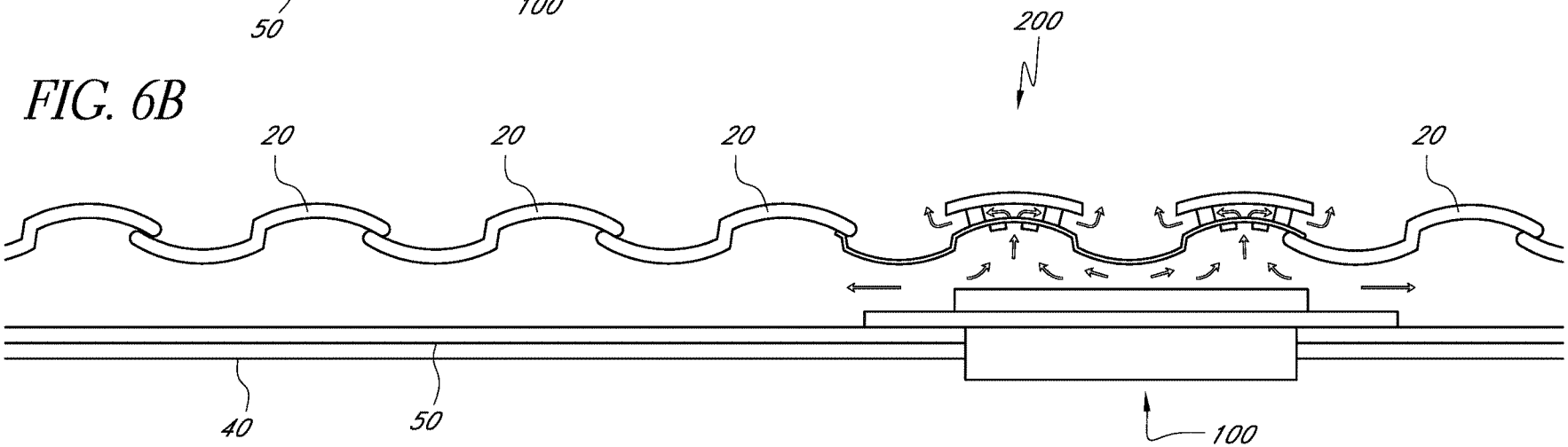
FIG. 6B is a schematic cross-sectional view of a roof section including another embodiment of a ventilation system.

However, as noted above, in some embodiments it may be desirable to position the first vent member 100 in a different portion of the roof than the second vent member 200. FIGS. 6A and 6B illustrate an embodiment in which the first vent member 100 is laterally displaced relative to the second vent member 200. FIG. 6A is a cross sectional view of a sloped roof along the sloped direction. FIG. 6B is a cross sectional view of the roof along the direction perpendicular to the sloped direction. As shown in FIGS. 6A and 6B, air flows up through the first vent member 100, then through the air permeable gap 32 between the roof deck 50 and the cover elements 20 until it reaches the second vent member 200, then through the second vent member 200. It will also be appreciated that some air flow may be permitted between the cover elements 20, such that some air exits the air permeable gap 32 without flowing through the secondary vent member 200. Further, although the foregoing description describes a primary direction of air flow in some embodiments, other air currents may also be present in the air permeable gap 32, including air flow in a reverse direction from that described above.

FIG. 6A illustrates an embodiment in which the first vent member 100 is positioned downslope with respect to the second vent member 200. In this configuration, flow-through battens 30 enable the movement of air along the slope of the roof, such that air from the first vent member 100 can travel upslope in the air permeable gap 32 through the battens 30 toward the second vent member 200. Downslope or upslope offsetting of the first vent member 100 relative to the second vent member 200 can be in addition or as an alternative to laterally displacing the first vent member 100 relative to the second vent member 200. In other configurations, the first and second vent members can be laterally displaced with respect to one another but are not substantially offset upslope or downslope, such that the positions of the first and second vent members along the slope of the roof are similar.

As described above, displacing (laterally or upslope/downslope) the first vent member 100 relative to the second vent member 200 can advantageously provide a further barrier to entry of embers or flames through the vent system 10. Displacement can additionally protect persons walking on the roof, such as firefighters, from falling through or into holes in the roof deck. This is because if a person's foot falls through the second vent member 200, displacing the hole in the roof deck 50 (i.e., the hole at which the first vent member 100 is positioned) away from the second vent member 200 helps to prevent the hole from being located in a position where the foot will proceed through the roof deck hole. Thus, if a person's foot breaks through the second vent member 200, the fall can be stopped by the roof deck 50. Displacement of the first and second vent members 100, 200 can provide other performance advantages as well. For example, it has been found that displacement can help to prevent "backloading" of the vent system. Backloading occurs when unusual conditions, such as strong winds or violent storms, force air to flow through a vent system in a direction opposite from the direction for which the vent system was designed.

Figure 7:
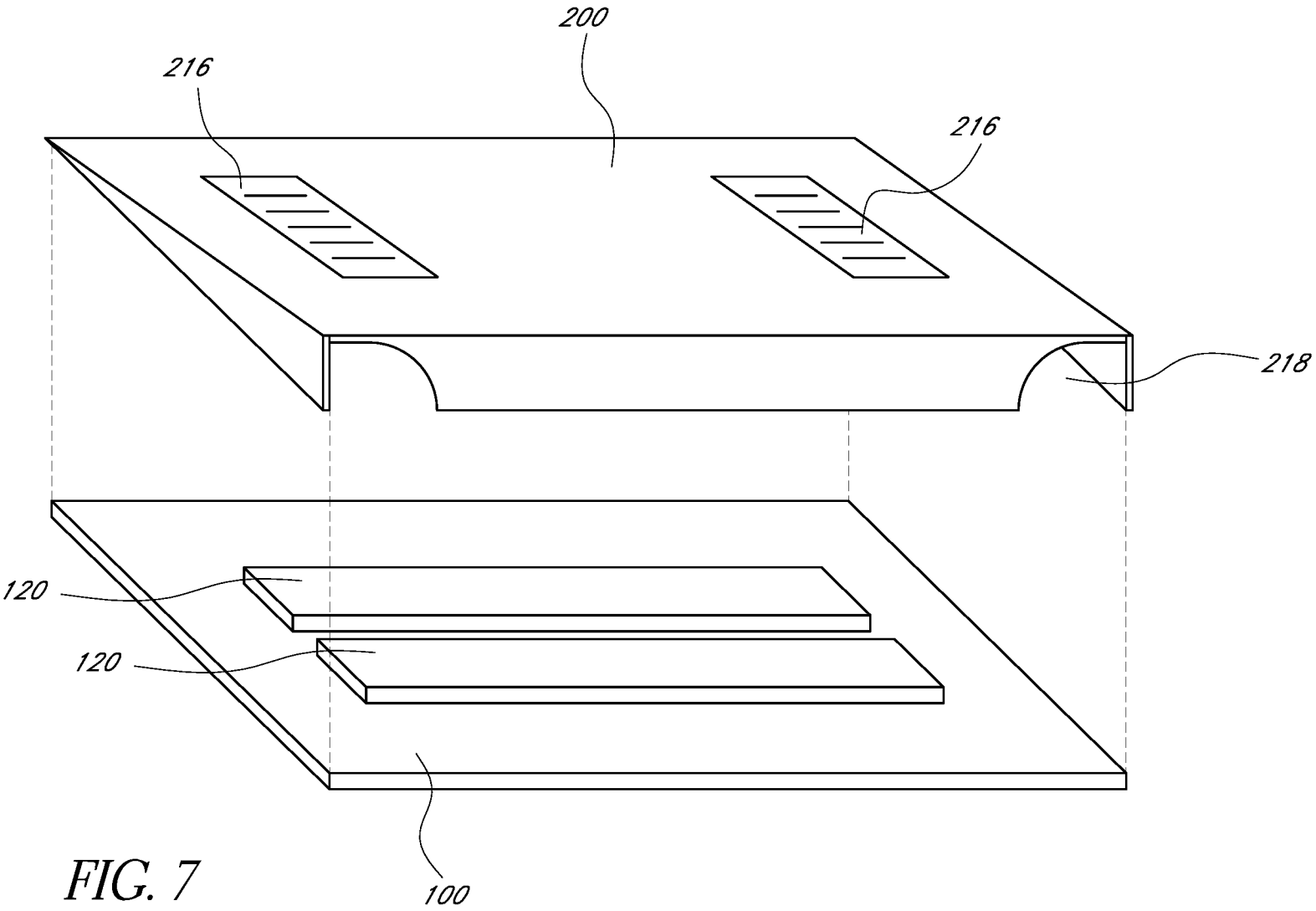
FIG. 7 is a schematic perspective view of another embodiment of a roof ventilation system.
Figure 8A:
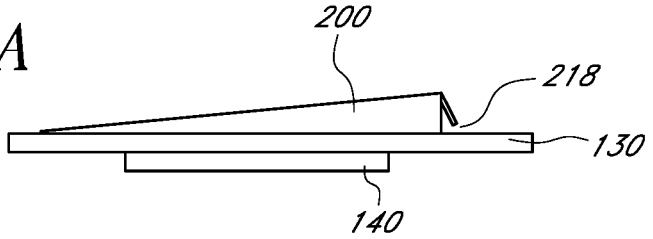
FIG. 8A is a side view of the roof ventilation system shown in FIG. 7.
Figure 8B:
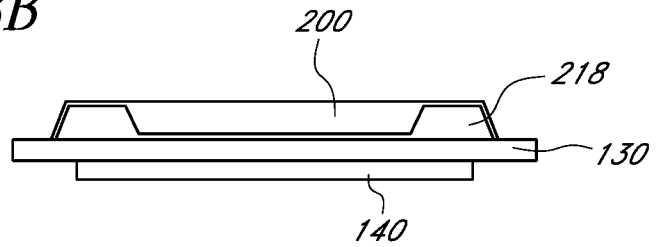
FIG. 8B is a front view of the roof ventilation system shown in FIG. 7.
Figure 8C:
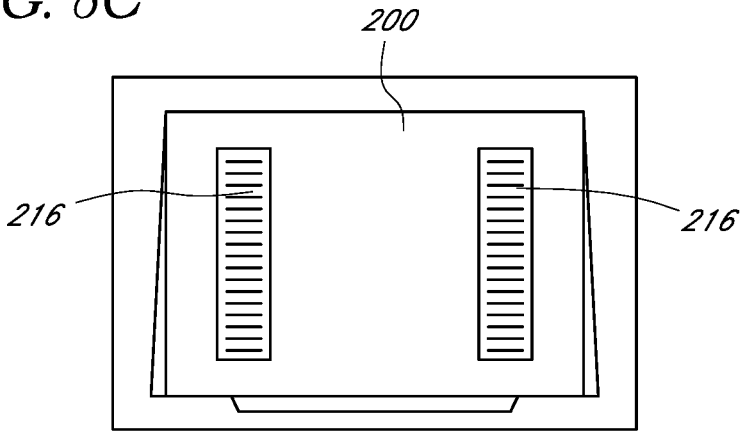
FIG. 8C is a top view of the roof ventilation system shown in FIG. 7.

FIG. 7 is a schematic perspective view of another embodiment of a roof ventilation system 10, in which the first vent member 100 and the second vent member 200 can be joined to form an integrated one-piece vent. One example of an integrated one-piece vent is disclosed in U.S. Pat. No. 6,390,914, the entirety of which is incorporated herein by reference. Another example of an integrated one-piece vent is disclosed in U.S. Pat. No. D549,316, the entirety of which is also incorporated herein by reference. The one-piece system shown in FIG. 7 may be of particular use in so-called composition roofs formed of composite roof materials. FIGS. 8A-8C show alternate views of the one-piece system shown in FIG. 7.

The first vent member 100 of the one-piece embodiment can be configured substantially as described hereinabove with reference to FIGS. 3A-3D. The second vent member 200 of the one-piece embodiment includes a tapered top with louver slits 216 on its top surface and an opening 218 on its front edge. Between the first vent member and the second vent member is a cavity, which may include screens or other filtering structures to prevent the ingress of debris, wind-driven rain, and pests. The cavity may further include baffle members 120 as described hereinabove to prevent the ingress of embers or flames. In use, air from a region below the roof deck passes through the first vent member 100, which can include baffle members 120, then through a cavity between the first and second vent members 100, 200, then through the louver slits 216 and/or the opening 218. The one-piece embodiment shown in FIGS. 7-8C can be helpful in applications in which convenience of installation is a primary concern.

Figure 9:
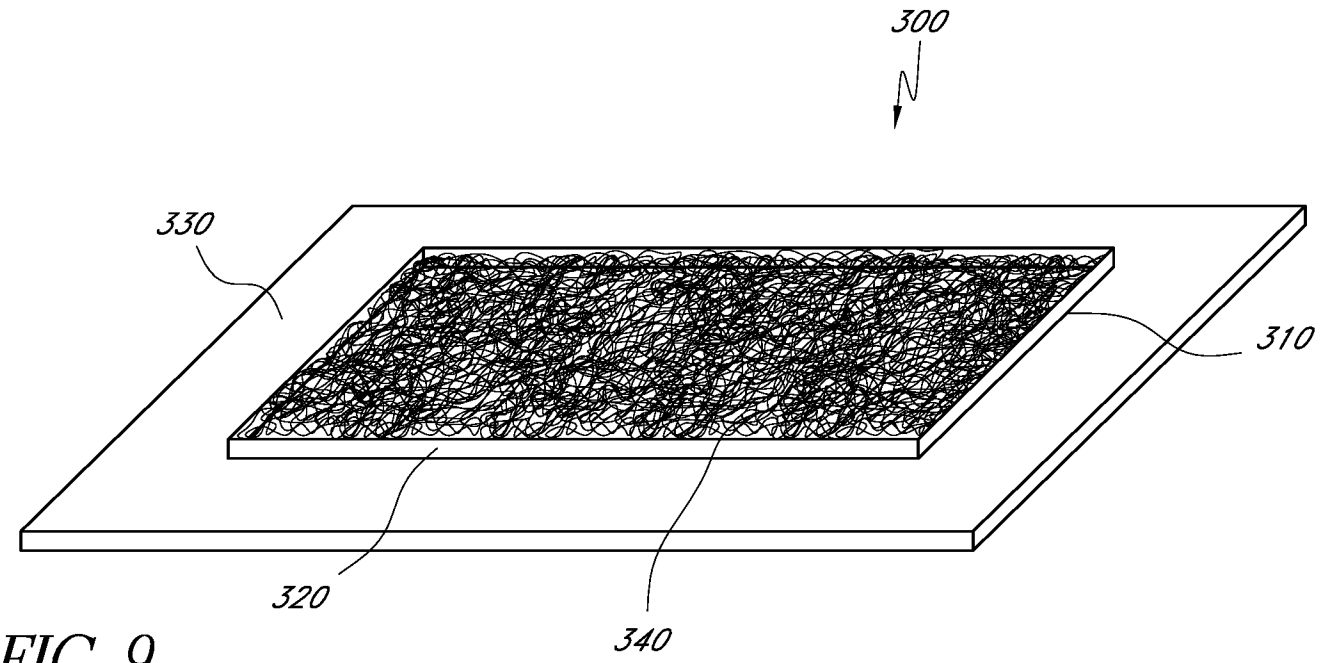
FIG. 9 is a top perspective view of a first vent member in accordance with another embodiment of a roof ventilation system.

FIG. 9 is a top perspective view of a first vent member 300 in accordance with another embodiment. The first vent member 300 includes a base 330 that can rest on or above a roof deck, similarly to the base 130 shown in FIGS. 1 and 3 and described above. The base 330 includes an opening 310 permitting air flow between a region below the roof deck and a region above the first vent member 300. In the illustrated embodiment, the opening 310 is rectangular. However, the opening 310 can have a variety of different shapes, including circular or elliptical. An upstanding baffle wall or flange 320 surrounds the opening 310. The baffle wall 320 can prevent water on the roof deck from flowing through the opening 310.

With continued reference to FIG. 9, the first vent member 300 includes an ember impedance structure comprising a mesh material 340 within the opening 310. In certain embodiments, the mesh material 340 is a fibrous interwoven material. In certain embodiments, the mesh material 340 is flame-resistant. The mesh material 340 can be formed of various materials, one of which is stainless steel. In one preferred embodiment, the mesh material 340 is stainless steel wool made from alloy type AISI 434 stainless steel, approximately ¼" thick. This particular steel wool can resist temperatures in excess of 700° C. as well as peak temperatures of 800° C. (up to 10 minutes without damage or degradation), does not degrade significantly when exposed to most acids typically encountered by roof vents, and retains its properties under typical vibration levels experienced in roofs (e.g., fan-induced vibration). Also, this particular steel wool provides a NFVA of approximately 133.28 inches per square foot (i.e., 7% solid, 93% open). This is a higher NFVA per square foot than the wire mesh that is used across openings in subflashings (i.e., primary vent members) of roof vents sold by O'Hagins Inc. Some of such commercially available subflashings employ ¼" thick galvanized steel wire mesh as a thin screen. For subflashing openings of approximately 7"×19", these commercially available vents provide approximately 118 square inches of NFVA.

The mesh material can be secured to the base 330 and/or baffle wall 320 by any of a variety of different methods, including without limitation adhesion, welding, and the like. In some embodiments, the base 330 includes a ledge (not shown) extending radially inward from the baffle wall 320, the ledge helping to support the mesh material 340.

In various embodiments, the mesh material 340 substantially inhibits the ingress of floating embers. Compared to the baffle members 120 and 220 described above, the mesh material 340 may provide greater ventilation. The baffle system restricts the amount of net free ventilating area (NFVA) under the ICC Acceptance Criteria for Attic Vents—AC132. Under AC132, the amount of NFVA is calculated at the smallest or most critical cross-sectional area of the airway of the vent. Sections 4.1.1 and 4.1.2 of AC132 (February 2009) read as follows:

"4.1.1. The net free area for any airflow pathway (airway) shall be the gross cross-sectional area less the area of any physical obstructions at the smallest or most critical cross-sectional area in the airway. The net free area shall be determined for each airway in the installed device."

"4.1.2. The NFVA for the device shall be the sum of the net free areas determined for all airways in the installed device."

Consider now the roof vent 10 illustrated in FIG. 1, and assume for simplicity that it includes baffle members 120 but no baffle members 220. The NFVA of the roof vent 10 is the area of the opening 110 of the primary vent member 100, minus the restrictions to the pathway. In other words, the NFVA is the sum total of the area provided by the baffle members 120. With respect to FIG. 4A3, the NFVA is the sum total of the area provided by the gap W multiplied by the length of the baffle members 120 (i.e., the dimension extending perpendicularly to the plane of the drawing, as opposed to the dimension L), multiplied further by the number of such gaps W (which depends on the number of baffle members).

Contrast that with a roof vent employing a primary vent member 300 as shown in FIG. 9. As noted above, the mesh material 340 can provide a similar level of resistance to the ingress of floating embers, as compared to the baffle members 120 (or 220). In certain embodiments, however, the primary vent member 300 provides increased ventilation airflow. As noted above, a mesh material 340 comprising stainless steel wool made from alloy type AISI 434 stainless steel provides a NFVA of approximately 133.28 inches per square foot (i.e., 7% solid, 93% open). In contrast, vents employing baffle members 120 and/or 220 are expected to provide, in certain embodiments, about 15-18% open area. The increased NFVA provided by the mesh material 340 makes it possible for a system employing primary vent members 300 to meet building codes (which typically require a minimum amount of NFVA) using a reduced number of vents, providing a competitive advantage for builders and roofers in terms of total ventilation costs.

Figure 10A:
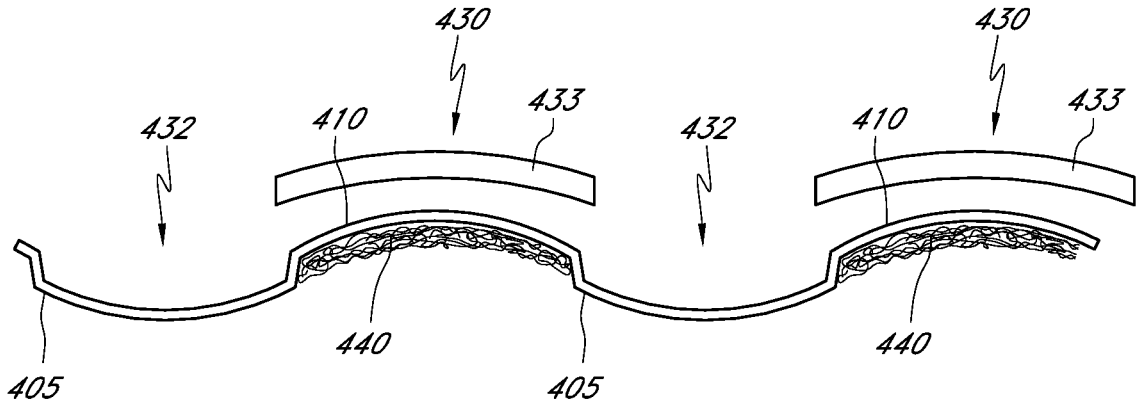
FIG. 10A is a front view of a second vent member in accordance with another embodiment of a roof ventilation system.

FIG. 10A is a front view of a secondary vent member 400, in accordance with one embodiment. The secondary vent member 400 can be similar in almost all respects to the secondary vent member 200 shown in FIG. 2, except for the additional provision of mesh material 440. In particular, the secondary vent member 400 includes a body 405 defining pan sections 432 and cap sections 430. Covers 433 are provided at the cap sections 430, spaced apart from the body 405 by, e.g., spacer brackets (now shown). The body 405 includes openings 410 at the cap sections 430. A mesh material 440 is provided at the openings 410, secured to the underside of the body 405 by any of a variety of available methods, including adhesion, welding, and the like. The mesh material 440 can comprise the materials described above for the mesh material 340 of FIG. 9. While the embodiment illustrated in FIG. 10A is configured for use in a roof having S-shaped tiles, other embodiments can be configured to interact with roofs having other types of cover elements. For example, the second vent member 400 can also be configured to mimic the appearance of so-called "M-shaped" tiles or flat tiles.

Figure 10B:
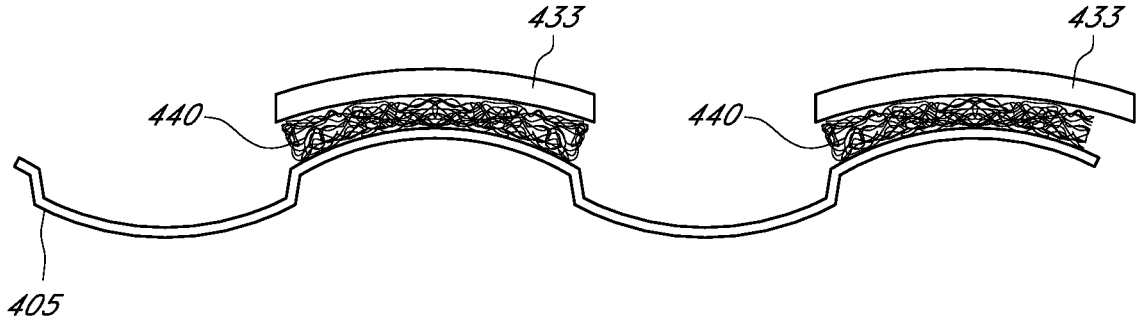
FIG. 10B is a front view of a second vent member in accordance with another embodiment of a roof ventilation system.

FIG. 10B is a front view of a secondary vent member 400 that is similar to that of FIG. 10A, except that the mesh material 440 is interposed between the body 405 and the covers 433. The mesh material 440 can be secured to the body 405 and/or covers 433 by any of a variety of available methods, including adhesion, welding, and the like.

Figure 10C:
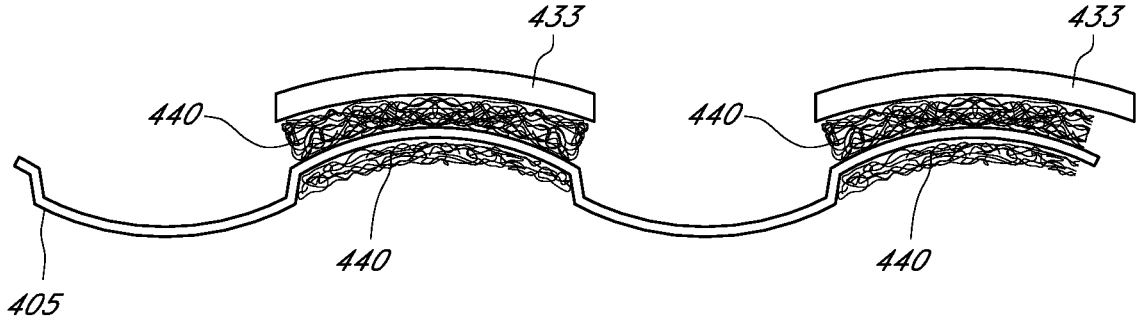
FIG. 10C is a front view of a second vent member in accordance with another embodiment of a roof ventilation system.

FIG. 10C is a front view of a secondary vent member 400 that is similar to that of FIG. 10A, except that, in addition to the mesh material 440 at the underside of the body 405, further mesh material 440 is interposed between the body 405 and the covers 433. The mesh material 440 can be secured to the body 405 and/or covers 433 by any of a variety of available methods, including adhesion, welding, and the like.

FIGS. 10A-10C show mesh material 440 positioned underneath or above the openings 410. In other embodiments, the mesh material 440 can be partially or entirely within the openings 410.

In preferred embodiments, the vents disclosed herein are preferably designed to engage surrounding roof cover elements (e.g., roof tiles) in accordance with a repeating engagement pattern of the cover elements. In other words, embodiments of the vents can be assembled with the roof cover elements without cutting or otherwise modifying the cover elements to fit with the vents. As explained above, the secondary vent member (including without limitation all of the embodiments described herein) can be offset laterally, upslope, or downslope from the primary vent member (including without limitation all of the two-piece embodiments described herein), for example by 2-4 roof cover elements. When utilized in conjunction with fire-resistant underlayment and construction materials, this offsetting of the vent members provides added protection against flame and ember intrusion into the building.

Figure 11:
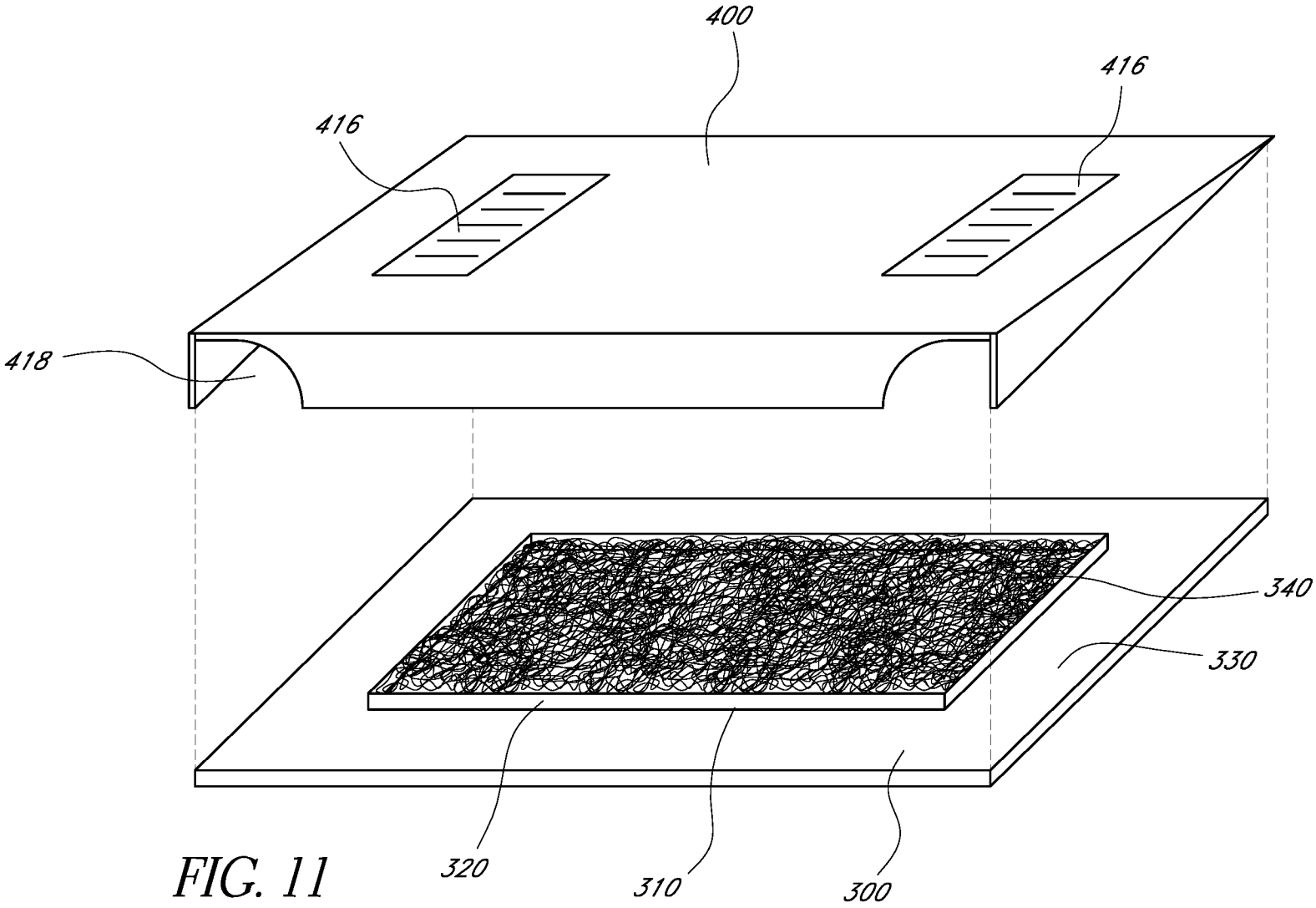
FIG. 11 is a schematic perspective view of another embodiment of a roof ventilation system.

FIG. 11 is a schematic perspective view of another embodiment of a roof ventilation system in which the first vent member 300 and the second vent member 400 can be joined to form an integrated one-piece vent. As noted above, examples of an integrated one-piece vent are disclosed in U.S. Pat. Nos. 6,390,914 and D549,316, the entireties of which are incorporated herein by reference. The one-piece system shown in FIG. 11 may be of particular use in so-called composition roofs formed of composite roof materials.

The first vent member 300 of the one-piece embodiment can be configured substantially as described hereinabove with reference to FIG. 9. The first vent member 300 can include mesh material 340 within the opening 310 in the base 330. In the illustrated embodiment, the opening 310 is rectangular, but the opening 310 can have a variety of different shapes, including circular or elliptical. An upstanding baffle wall or flange 320 surrounds the opening 310. The baffle wall 320 can prevent water on the roof deck from flowing through the opening 310.

The second vent member 400 of the one-piece embodiment includes a tapered top with louver slits 416 on its top surface and an opening 418 on its front edge. Between the first vent member 300 and the second vent member 400 is a cavity, which may include screens or other filtering structures to prevent the ingress of debris, wind-driven rain, and pests. In use, air from a region below the roof deck passes through the first vent member 300 then through a cavity between the first and second vent members 300, 400, then through the louver slits 416 and/or the opening 418. The one-piece embodiment shown in FIG. 11 can be helpful in applications in which convenience of installation is a primary concern. Moreover, the one-piece embodiment is advantageous in that its low profile design promotes flame resistance, insofar as flames tend to pass over the vent rather than through the vent's openings. This can be contrasted with a high profile vent design, such as a dormer vent, which presents a natural point of entry for flames and embers to pass through the openings in the vent.

Figure 12:
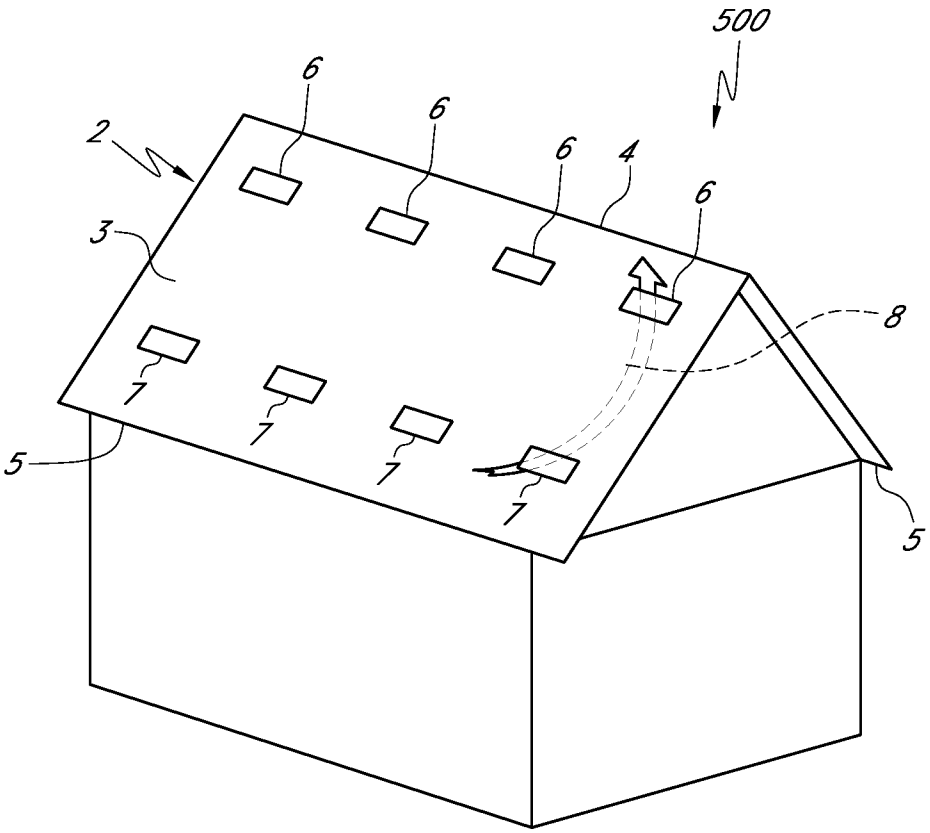
FIG. 12 is a perspective view of a building with a roof ventilation system in accordance with a preferred embodiment.

FIG. 12 is a perspective view of a building 500 having a system of vents 6, 7 in accordance with an embodiment. The building has a roof 2 with a ridge 4 and two eaves 5. Between the ridge 4 and each eave 5 is defined a roof field 3, one of which is shown in the figure. It will be understood that more complex roofs may have more than two fields 3. In an embodiment, at least one of the fields 3 of the building 500 includes a plurality of field vents 6, 7 with ember and/or flame impedance structures (such as the vents described above). In the illustrated embodiment, a plurality of field vents 6 is provided near the ridge 4, preferably aligned substantially parallel to the ridge. In certain embodiments, the field vents 6 are spaced by 1-4 roof cover elements (e.g., tiles) from the ridge 4. In the illustrated embodiment, a plurality of field vents 7 is provided near the eave 5, preferably aligned substantially parallel to the eave. In certain embodiments, the field vents 7 are spaced by 1-4 roof cover elements (e.g., tiles) from the eave 5. In use, the vents 6, 7 in this arrangement promote air flow through the attic as indicated by the arrow 8. That is, air tends to flow into the building (e.g., into an attic of the building) through the vents 7, and air tends to exit the building through the vents 6. Also, the roof can have a batten cavity, as described above, through which air may also flow.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. A roof vent, comprising:

a base portion configured to rest upon a roof deck, the base portion including a first opening;

a top portion comprising a second opening, the top portion positioned above the base portion;

a cavity formed between the base portion and the top portion;

a fire-resistant mesh material disposed within the cavity, wherein a flow path is formed from a first region below the roof deck, through each of the first opening, fire-resistant mesh material, cavity and second opening, to a second region, the second region positioned above the roof deck and the top portion, and wherein the mesh material provides a net free ventilating area with greater than about 80% open area and is configured to substantially prevent the ingress of floating embers into the top portion.

2. The roof vent of claim 1, further comprising a screen disposed within the cavity, wherein the flow path is formed through the screen.

3. The roof vent of claim 2, wherein the base and top portions are configured to form a one-piece, low profile vent design.

4. The roof vent of claim 3, wherein the base and top portions are one integrally formed piece.

5. The roof vent of claim 3, wherein the base and top portions are separate pieces secured to one another.

6. The roof vent of claim 3, wherein the top portion includes a tapered top.

7. The roof vent of claim 6, wherein the tapered top comprises at least a flat portion, further comprising a plurality of louver slits extending through the flat portion, wherein a first of the plurality of louver slits forms the second opening.

8. The roof vent of claim 7, wherein the mesh material comprises steel wool.

9. The roof vent of claim 8, wherein the mesh material comprises flame-resistant steel wool.

10. The roof vent of claim 9, wherein the steel wool is made from AISI 434 stainless steel.

11. The roof vent of claim 9, wherein the mesh material is approximately ¼" thick.

12. The roof vent of claim 10, wherein the mesh material provides a net free ventilating area of greater than 125 inches per square foot.

13. The roof vent of claim 1, wherein the mesh material provides a net free ventilating area with greater than about 90% open area.

14. The roof vent of claim 13, wherein at least one of the top and base portions is configured to be oriented substantially parallel to a roof field when the vent is installed in the roof field.

15. The roof vent of claim 14, wherein the top portion is configured to engage surrounding roof cover elements.

16. The roof vent of claim 15, wherein the top portion is configured to simulate an appearance of one or more roof cover elements.

17. A roof segment comprising the roof vent of claim 15 and a layer of roof cover elements, wherein the top portion is positioned substantially within the layer of roof cover elements.

18. A building, comprising a roof having the roof segment of claim 17.

* * * * *